US012503269B2

(12) United States Patent
Nakamura et al.

(10) Patent No.: US 12,503,269 B2
(45) Date of Patent: Dec. 23, 2025

(54) PAPER CONTAINER

(71) Applicant: NIPPON PAPER INDUSTRIES CO., LTD., Tokyo (JP)

(72) Inventors: Kouya Nakamura, Tokyo (JP); Atsushi Tanaka, Tokyo (JP); Junichi Masuda, Tokyo (JP)

(73) Assignee: NIPPON PAPER INDUSTRIES, CO., LTD., Tokyo (JP)

( * ) Notice: Subject to any disclaimer, the term of this patent is extended or adjusted under 35 U.S.C. 154(b) by 253 days.

(21) Appl. No.: 17/778,661

(22) PCT Filed: Nov. 20, 2020

(86) PCT No.: PCT/JP2020/043527
§ 371 (c)(1),
(2) Date: May 20, 2022

(87) PCT Pub. No.: WO2021/100879
PCT Pub. Date: May 27, 2021

(65) Prior Publication Data

US 2022/0411123 A1 Dec. 29, 2022

(30) Foreign Application Priority Data

Nov. 22, 2019 (JP) ..... 2019-210993
Mar. 23, 2020 (JP) ..... 2020-051806
Mar. 23, 2020 (JP) ..... 2020-051810

(51) Int. Cl.
*B65D 5/06* (2006.01)
*B65D 5/40* (2006.01)
(Continued)

(52) U.S. Cl.
CPC ..... *B65D 5/068* (2013.01); *B65D 5/40* (2013.01); *B65D 5/4266* (2013.01); *B65D 5/563* (2013.01); *B65D 5/742* (2013.01)

(58) Field of Classification Search
CPC ..... B65D 5/068; B65D 5/40; B65D 5/4266; B65D 5/563; B65D 5/742; B65D 2231/02;
(Continued)

(56) References Cited

U.S. PATENT DOCUMENTS 4,586,650 A * 5/1986 Sasaki ..... B65D 5/4266 229/920
4,909,432 A * 3/1990 Nagata ..... B65D 5/067 229/920
(Continued)

FOREIGN PATENT DOCUMENTS

JP 2002-234524 8/2002
JP 2009-83885 4/2009
(Continued)

OTHER PUBLICATIONS

International Search Report issued Jan. 26, 2021 in International (PCT) Application No. PCT/JP2020/043527.

*Primary Examiner* — Christopher R Demeree
(74) *Attorney, Agent, or Firm* — Wenderoth, Lind & Ponack, L.L.P.

(57) ABSTRACT

A paper container includes a body panel on which a first auxiliary folding line having an upwardly curved shape is formed to have end portions arranged so as to connect reference points to each other, or connect together positions that are near the reference points on body vertical folding lines or positions that are away from the body vertical folding lines and below the reference points in a height direction of each of the body vertical folding lines.

16 Claims, 27 Drawing Sheets

(51) Int. Cl.
*B65D 5/42* (2006.01)
*B65D 5/56* (2006.01)
*B65D 5/74* (2006.01)

(58) Field of Classification Search
CPC ..... B65D 5/0209; B65D 5/745; B65D 5/42; B65D 5/741; B65D 5/067; B65D 5/746; B65D 5/4279; B32B 2439/70; B32B 27/10; B32B 15/12
USPC ..... 229/214, 137, 930, 125.42, 920, 213, 229/5.84, 116.1, 117.01, 249; 206/459.5; 428/172
See application file for complete search history.

(56) References Cited

U.S. PATENT DOCUMENTS 5,474,232 A * 12/1995 Ljungstrom ..... B65D 5/067 229/184
5,803,349 A * 9/1998 Ljungstrom ..... B65D 5/745 229/137
5,848,749 A 12/1998 Ljungström
8,302,846 B2 * 11/2012 Koeda ..... B65D 5/745 229/137
8,814,034 B2 * 8/2014 Dickie ..... B65D 5/746 206/459.5
9,611,065 B2 * 4/2017 Franic ..... B65D 5/067
11,667,428 B2 * 6/2023 Barbieri ..... B32B 27/08 229/137
11,772,841 B2 * 10/2023 Ronchetti ..... B32B 15/20 229/5.81

FOREIGN PATENT DOCUMENTS

JP 2017-202849 11/2017
JP 2018-172128 11/2018
JP 2019-196191 11/2019

* cited by examiner

PAPER CONTAINER

TECHNICAL FIELD

The present invention relates to a paper container for storing a liquid content.

BACKGROUND ART

Hitherto, a gable roof-type paper container has been widely used as a paper container for storing a liquid content such as milk or juice. The gable roof-type paper container is formed of a paperboard material having a thermoplastic resin laminated on each of a front surface and a back surface thereof. The gable roof-type paper container includes four body panels. A vertical direction sealing panel joins edge portions of the body panels so that a quadrangular tubular body is formed. A pair of gable roof forming panels including outer-side top sealing panels at upper portions thereof and being opposed to each other are contiguous with upper ends of the body panels are contiguous with upper ends of the body panels, and a pair of gable wall forming panels including inner-side top sealing panels at upper portions thereof and any one of which being formed into a pouring spout to be unsealed are contiguous with upper ends of the body panels. The pair of gable wall forming panels are folded between the pair of gable roof forming panels, and the outer-side top sealing panels and the inner-side top sealing panels are heated, sealed, and tightly closed at predetermined positions, thereby forming a top portion of the paper container.

The gable roof-type paper container described above is unsealed as follows. Fingers are inserted into a space defined to have an opening between the pair of gable roof forming panels, the body panel, and the gable wall forming panel, and the fingers are put on the gable wall forming panel so as to expand the space laterally. In this manner, unsealed-side opposing surfaces between the outer-side top sealing panels and the inner-side top sealing panel, which are heated and sealed, are separated from each other. Then, the gable wall forming panel folded between the pair of gable roof forming panels is pulled, and the paper container is folded toward an outer side thereof along a top portion horizontal folding line at a boundary between the gable wall forming panel and the body panel that is contiguous with the gable wall forming panel through the top portion horizontal folding line, thereby forming the pouring spout. However, for example, in a case in which a hand of a user is large, the paper container has a small size, or a height of the gable roof-shaped top portion is reduced for the purpose of space saving, the space defined between the body panel and the gable wall forming panel is narrow. Thus, there has been a problem in that it is difficult to put the fingers on the gable wall forming panel so that an unsealing operation cannot be easily performed.

As a paper container for solving the above-mentioned problem, in recent years, there has been known the following gable roof-type paper container (see, for example, JP 2002-234524). Specifically, the paper container includes an auxiliary folding line formed in a vicinity of a top portion horizontal folding line located at a boundary between a gable wall forming panel, which is to be pulled at the time of unsealing of the paper container, and a body panel contiguous with the gable wall forming panel. The auxiliary folding line stretches from one end portion to another end portion of the top portion horizontal folding line so as to extend toward a center of the body panel.

With the gable roof-type paper container including the auxiliary folding line described above, when a top-portion corner portion of a body formed along the top portion horizontal folding line is pushed in toward an inner side of the container, the paper container is mountain-folded along the auxiliary folding line, and the top-portion corner portion is curved toward the inner side of the container so that an upper portion of the body panel located between the top portion horizontal folding line and an opening auxiliary line is dented toward the inner side of the container. Thus, a space into which fingers are to be inserted when the fingers are put on the gable wall forming panel at the time of unsealing is expanded, thereby being capable of easily unsealing the paper container.

SUMMARY OF INVENTION

Technical Problem

However, in the paper container as described in JP 2002-234524, the end portions of the auxiliary folding line are connected with end portions of the top portion horizontal folding lines, respectively. Thus, the paper container as described in JP 2002-234524 has the following problem: when pressure is applied to mountain-fold a carton blank along the top portion horizontal folding line at the time of formation of the gable roof-shaped top portion of the paper container, the pressure force is transmitted to the auxiliary folding line, and the carton blank is mountain-folded along the auxiliary folding line and distorted so that a defective product may be produced.

Further, a folding position in the top-portion corner portion varies depending on a position of pushing the top-portion corner portion. As a result, there has been a problem in that a size of the space, which is defined by denting the upper portion of the body panel located between the top portion horizontal folding line and the auxiliary folding line toward the inner side of the container, is not fixed so that it is sometimes difficult to insert fingers into the space.

Further, at the time of unsealing of the paper container, the top-portion corner portion of the body formed along the top portion horizontal folding line is pushed in toward the inner side of the container so as to be folded toward the inner side. However, the top-portion corner portion has an action of functioning as a rib, and hence a large force is required to fold the top-portion corner portion of the body toward the inner side. Thus, there has been a problem in that it is sometimes difficult for a physically weak person, such as an aged person, a woman, or a child, to perform the unsealing operation of the paper container.

In view of the above-mentioned problems, the inventors of the present invention have completed the present invention as a result of extensive studies on a position and a shape of the auxiliary folding line that is formed on the body and allows the body panel to be dented along the auxiliary folding line when the pouring spout is formed.

It is an object of the present invention to provide a paper container, which allows an upper end portion of a body panel to be reliably dented by a small force at the time of unsealing of the paper container so as to be easily unsealed, and causes no fear in that the paper container is distorted at the time of forming the paper container.

Solution to Problem

In order to achieve the above-mentioned object, according to the invention described in a first aspect, there is provided a paper container, which is a gable roof type and is formed of a paperboard material having a thermoplastic resin laminated on each of a front surface and a back surface of the paperboard material, the paper container including: four body panels; a vertical direction sealing panel, which joins edge portions of the four body panels so that the four body panels form a quadrangular tubular body; a pair of gable roof forming panels, which are contiguous with upper ends of the body panels, and include outer-side top sealing panels at upper portions of the pair of gable roof forming panels, respectively and are opposed to each other; a pair of gable wall forming panels, which are contiguous with upper ends of the body panels, and include inner-side top sealing panels at upper portions of the pair of gable wall forming panels, respectively, and are opposed to each other, any one of the pair of gable wall forming panels being formed into a pouring spout to be unsealed; and a top portion formed by folding the pair of gable wall forming panels between the pair of gable roof forming panels, and by heating, sealing, and tightly closing the outer-side top sealing panels and the inner-side top sealing panels at predetermined positions, wherein, in an unsealed-side body panel among the four body panels, which is contiguous with the unsealed-side gable wall forming panel through a top portion horizontal folding line, reference points are respectively set on body vertical folding lines that are located on both sides of the unsealed-side body panel, wherein each of the reference points is distant by 3 mm or more from an intersection of an end portion of each of the body vertical folding lines and an end portion of the top portion horizontal folding line, wherein, on the unsealed-side body panel, a first auxiliary folding line having an upwardly curved shape is formed to have end portions arranged so as to connect the reference points to each other, or connect together positions that are near the reference points on the body vertical folding lines or positions that are away from the body vertical folding lines and below the reference points in a height direction of each of the body vertical folding lines, and wherein the end portions of the first auxiliary folding line, which connect together the positions that are near the reference points on the body vertical folding lines or the positions that are away from the body vertical folding lines and below the reference points in the height direction, are each distant from the intersection by 3 mm or more and by a range within a length equal to or smaller than 20% of a length of the top portion horizontal folding line.

According to the invention described in the first aspect, in the unsealed-side body panel contiguous with the unsealed-side gable wall forming panel through the top portion horizontal folding line, the reference points are respectively set on the body vertical folding lines located on both sides of the unsealed-side body panel, and each of the reference points is distant by 3 mm or more from the intersection of the end portion of each of the body vertical folding lines and the end portion of the top portion horizontal folding line. On the body panel, the first auxiliary folding line having an upwardly curved shape is formed to have the end portions arranged so as to connect the reference points to each other, or connect together the positions that are near the reference points on the body vertical folding lines or positions that are away from the body vertical folding lines and below the reference points in the height direction. The end portions of the first auxiliary folding line, which connect together the positions that are near the reference points on the body vertical folding lines or the positions that are away from the body vertical folding lines and below the reference points in the height direction, are each distant from the intersection by 3 mm or more and by the range within the length equal to or smaller than 20% of the length of the top portion horizontal folding line. Accordingly, when pressure is applied to mountain-fold the carton blank along the top portion horizontal folding line at the time of formation of the gable roof-shaped top portion of the paper container, bending load bearing portions in the body panel between the top portion horizontal folding line and the end portions of the first auxiliary folding line can be prevented from being buckled by a small force. In addition, there can be prevented a situation in which a large force accompanied with trouble is required for buckling.

Accordingly, when pressure is applied to mountain-fold the carton blank along the top portion horizontal folding line at the time of formation of the gable roof-shaped top portion of the paper container, the bending load bearing portions in the body panel between the top portion horizontal folding line and the end portions of the first auxiliary folding line are not buckled by a small force. Thus, there can be effectively prevented a situation in which the carton blank is mountain-folded along the first auxiliary folding line and distorted so that a defective product is produced.

Further, at the time of unsealing of the paper container, the bending load bearing portions in the body panel between the top portion horizontal folding line and the end portions of the first auxiliary folding line are buckled without requiring a large force, and hence the top-portion corner portion of the tubular body can be easily pushed in. Thus, the body panel is mountain-folded along the first auxiliary folding line, and buckling is caused in the bending load bearing portions in the body panel between the top portion horizontal folding line and the end portions of the first auxiliary folding line, thereby being capable of denting the upper end portion of the body panel. When the upper end portion of the body panel is dented, the top-portion corner portion is curved toward the inner side of the container. As a result, a space into which fingers are to be inserted when the fingers are put on the gable wall forming panel at the time of unsealing is expanded, thereby being capable of easily unsealing the paper container.

Further, owing to the buckling of the bending load bearing portions in the body panel between the top portion horizontal folding line and the end portions of the first auxiliary folding line, deformed portions function as dampers, and can keep the dented state of the upper end portion of the body panel. Accordingly, the paper container can be easily unsealed.

According to the invention described in a second aspect, each of the reference points is distant from the intersection by a length of from 3 mm to 4 mm in an up-and-down direction of the paper container, and each of the end portions of the first auxiliary folding line is distant from the intersection by a length of from 5 mm to 6 mm.

According to the invention described in the second aspect, each of the reference points is distant from the intersection by the length of from 3 mm to 4 mm in the up-and-down direction, and each of the end portions of the first auxiliary folding line is distant from the intersection by the length of from 5 mm to 6 mm. Accordingly, the bending load bearing portions in the body panel between the top portion horizontal folding line and the end portions of the first auxiliary folding line are not buckled by a small force. Thus, there can be more effectively prevented the following situation: when pressure is applied to mountain-fold the carton blank along the top portion horizontal folding line at the time of formation of the gable roof-shaped top portion of the paper container, a force is transmitted to the first auxiliary folding line, and the carton blank is mountain-folded along the first auxiliary folding line and distorted so that a defective product is produced. In addition, at the time of unsealing of the paper container, buckling is caused without requiring a large force, thereby being capable of easily unsealing the paper container.

According to the invention described in a third aspect, the upwardly curved shape of the first auxiliary folding line is an arc shape, a V shape, a polygonal shape, or a combination of those shapes.

According to the invention described in the third aspect, the shape of the first auxiliary folding line is an arc shape, a V shape, a polygonal shape, or a combination of those shapes. Accordingly, at the time of unsealing of the paper container, when the top-portion corner portion of the tubular body, which is formed by folding the carton blank along the top portion horizontal folding line, or a vicinity of the top-portion corner portion is pushed in, the body panel can be easily mountain-folded along the first auxiliary folding line, thereby being capable of easily denting the upper end portion of the body panel.

According to the invention described in a fourth aspect, the first auxiliary folding line is a continuous line.

According to the invention described in the fourth aspect, the first auxiliary folding line is a continuous line. Accordingly, even when a paperboard material for forming the paper container has a large basis weight, the body panel can be easily mountain-folded along the first auxiliary folding line.

According to the invention described in a fifth aspect, the first auxiliary folding line is discontinuous lines.

According to the invention described in the fifth aspect, the first auxiliary folding line is discontinuous lines. Accordingly, even when a paperboard material for forming the paper container has a small basis weight, the first auxiliary folding line formed on the body panel does not reduce strength of the paper container, and strength required of the paper container can be kept.

According to the invention described in a sixth aspect, a lowermost point of a curve of the first auxiliary folding line is located at a center of the unsealed-side body panel in a right-and-left direction of the unsealed-side body panel.

According to the invention described in the sixth aspect, the lowermost point of the curve of the first auxiliary folding line is located at the center of the unsealed-side body panel in the right-and-left direction. Accordingly, a lowermost point of a space, which is defined between the pair of gable roof forming panels, the unsealed-side body panel, and the unsealed-side gable wall forming panel and expanded by denting the upper end portion of the body panel, is vertically aligned with a top of the space so that the space can have a shape allowing fingers to be easily inserted thereinto.

According to the invention described in a seventh aspect, the first auxiliary folding line is formed so as to be symmetrical.

According to the invention described in the seventh aspect, the first auxiliary folding line is formed so as to be symmetrical. Accordingly, the space, which is defined between the pair of gable roof forming panels, the unsealed-side body panel, and the unsealed-side gable wall forming panel and expanded by denting the body panel, has a symmetrical shape so that the space can have a shape allowing fingers to be easily inserted thereinto.

According to the invention described in an eighth aspect, a second auxiliary folding line is formed on a substantially triangular surface portion of the unsealed-side gable wall forming panel, or on the substantially triangular surface portion of the unsealed-side gable wall forming panel and the unsealed-side body panel so as to vertically extend along a center portion of the paper container in a horizontal direction thereof.

According to the invention described in the eighth aspect, the second auxiliary folding line is formed on the substantially triangular surface portion of the unsealed-side gable wall forming panel, or on the substantially triangular surface portion of the unsealed-side gable wall forming panel and the unsealed-side body panel so as to vertically extend along the center portion of the paper container in the horizontal direction thereof. Accordingly, at the time of unsealing of the paper container, when the top-portion corner portion of the tubular body is pushed in, owing to the second auxiliary folding line, the substantially triangular surface portion, or the substantially triangular surface portion and the body panel are valley-folded along the second auxiliary folding line so that the center portion of the top-portion corner portion of the tubular body is guided so as to be folded toward the inner side of the paper container.

Thus, the center portion of the top-portion corner portion of the tubular body can be easily folded toward the inner side of the paper container, and hence the substantially triangular surface portion and the upper end portion of the body panel can be easily dented by a small pushing force.

Further, owing to the second auxiliary folding line, a folding position in the top-portion corner portion is fixed, and hence a space over the unsealed-side gable wall forming panel, which is defined by a dent of the substantially triangular surface portion and a dent of the upper end portion of the body panel, has a fixed size.

According to the invention described in a ninth aspect, a lower end portion of the second auxiliary folding line on a side of the lowermost point of the first auxiliary folding line is located on the lowermost point of the first auxiliary folding line or in a vicinity of the lowermost point, and an upper end portion of the second auxiliary folding line on a side of a vertex of the substantially triangular surface portion is located on the vertex of the substantially triangular surface portion or in a vicinity of the vertex.

According to the invention described in the ninth aspect, the lower end portion of the second auxiliary folding line on the side of the lowermost point of the first auxiliary folding line is located on the lowermost point of the first auxiliary folding line or in the vicinity of the lowermost point, and the upper end portion of the second auxiliary folding line on the side of the vertex of the substantially triangular surface portion is located on the vertex of the substantially triangular surface portion or in the vicinity of the vertex. Accordingly, the body panel and the substantially triangular surface portion can be further easily dented.

According to the invention described in a tenth aspect, a point indication for indicating a pushing point is provided on a center portion of the top portion horizontal folding line or in a vicinity of the center portion so as to extend astride the substantially triangular surface portion and the body panel or extend in any one of the substantially triangular surface portion and the body panel.

According to the invention described in the tenth aspect, the point indication for indicating the pushing point is provided on the center portion of the top portion horizontal folding line or in the vicinity of the center portion so as to extend astride the substantially triangular surface portion and the body panel or extend in any one of the substantially triangular surface portion and the body panel. Accordingly, at the time of unsealing of the paper container, owing to the point indication, the center portion of the top-portion corner portion of the tubular body or the vicinity of the center portion can be reliably pushed in.

According to the invention described in an eleventh aspect, the point indication is formed by embossing.

According to the invention described in the eleventh aspect, the point indication is formed by embossing. Accordingly, even when it is difficult to visually recognize the point indication, the point indication can be easily recognized through touching. Further, when the embossed point indication is visually recognized, a design effect of the paper container can be exerted.

According to the invention described in a twelfth aspect, the inner-side top sealing panel, which is contiguous with an upper portion of any one of the pair of gable wall forming panels to be formed into the pouring spout and unsealed, has a straight upper side.

According to the invention described in the twelfth aspect, the inner-side top sealing panel, which is contiguous with the upper portion of the gable wall forming panel to be formed into the pouring spout and unsealed, has the straight upper side. Accordingly, sealing areas are small between the inner-side top sealing panel and the outer-side top sealing panels, which are located on both sides of the inner-side top sealing panel and are contiguous with the upper portions of the pair of gable roof forming panels. Thus, the inner-side top sealing panel and the outer-side top sealing panels can be easily separated from each other, and hence the paper container can be easily unsealed.

According to the invention described in a thirteenth aspect, a first easily-separable region is formed on an inner surface of the inner-side top sealing panel contiguous with the upper portion of any one of the pair of gable wall forming panels to be formed into the pouring spout and unsealed, and a second easily-separable region, which is to be superposed on the first easily-separable region, is formed on a portion of an inner surface of each of the outer-side top sealing panels on a side closer to the inner-side top sealing panel so as to cover almost half of each of the outer-side top sealing panels in a lateral length direction thereof, and the outer-side top sealing panels are located on both sides of the inner-side top sealing panel, and are contiguous with the upper portions of the pair of gable roof forming panels, respectively.

According to the invention described in the thirteenth aspect, the first easily-separable region is formed on the inner surface of the inner-side top sealing panel contiguous with the upper portion of the gable wall forming panel to be formed into the pouring spout and unsealed, and the second easily-separable region, which is to be superposed on the first easily-separable region, is formed on the portion of the inner surface of each of the outer-side top sealing panels on the side closer to the inner-side top sealing panel so as to cover almost half of each of the outer-side top sealing panels in the lateral length direction. The outer-side top sealing panels are located on both sides of the inner-side top sealing panel, and are contiguous with the upper portions of the pair of gable roof forming panels, respectively. Accordingly, the inner-side top sealing panel and the outer-side top sealing panels can be easily separated from each other, and hence the paper container can be easily unsealed.

According to the invention described in a fourteenth aspect, the first easily-separable region is formed such that an end sealing region having a predetermined lateral width is left at each end of the inner-side top sealing panel in a lateral length direction thereof, the second easily-separable region is formed such that an end sealing region having a predetermined lateral width is left at a portion of each of the outer-side top sealing panels on the side closer to the inner-side top sealing panel, the first easily-separable region includes extended portions, and the extended portions are respectively formed at both end portions of the first easily-separable region so as to extend in an inclined manner from an upper side to a lower side of the first easily-separable region so that widths become larger toward the body panel, and the second easily-separable region includes an extended portion, and the extended portion is formed at an end portion of the second easily-separable region on the side closer to the inner-side top sealing panel so as to extend in an inclined manner from an upper side to a lower side of the second easily-separable region so that a width becomes larger toward the body panel.

According to the invention described in the fourteenth aspect, the first easily-separable region is formed such that the end sealing region having the predetermined lateral width is left at each end of the inner-side top sealing panel in the lateral length direction thereof, and the second easily-separable region is formed such that the end sealing region having the predetermined lateral width is left at the portion of each of the outer-side top sealing panels on the side closer to the inner-side top sealing panel. The first easily-separable region includes the extended portions, and the extended portions are respectively formed at the both end portions of the first easily-separable region so as to extend in an inclined manner from the upper side to the lower side of the first easily-separable region so that the widths become larger toward the body panel. The second easily-separable region includes the extended portion, and the extended portion is formed at the end portion of the second easily-separable region on the side closer to the inner-side top sealing panel so as to extend in an inclined manner from the upper side to the lower side of the second easily-separable region so that the width becomes larger toward the body panel. Accordingly, inclination directions of upper sides of the extended portions of the first easily-separable region and the extended portion of the second easily-separable region are along separating directions of the end sealing regions present in the inner-side top sealing panel and the outer-side top sealing panels when the gable wall forming panel is pulled. With this configuration, the end sealing regions in the inner-side top sealing panel and the outer-side top sealing panels can be easily separated, and hence the paper container can be easily unsealed.

According to the invention described in a fifteenth aspect, a lateral width of each of the body panels is equal to or smaller than 57 mm.

According to the invention described in the fifteenth aspect, even when the paper container has such a small size that the lateral width of each of the body panels is equal to or smaller than 57 mm, there can be defined a wide space into which fingers are to be inserted in order to put the fingers on the unsealed-side gable wall forming panel at the time of unsealing of the paper container.

According to the invention described in a sixteenth aspect, in at least one of the pair of gable roof forming panels, a pouring spout for a straw is formed, and includes a first half-cut portion formed on a back surface side of the at least one of the pair of gable roof forming panels so as to serve as a straw slot, and a second half-cut portion formed on a front surface side of the at least one of the pair of gable roof forming panels so as to surround the first half-cut portion.

According to the invention described in the sixteenth aspect, in the at least one of the gable roof forming panels, the pouring spout for a straw is formed, and includes the first half-cut portion formed on the back surface side of the at least one of the gable roof forming panels so as to serve as a straw slot, and the second half-cut portion formed on the front surface side of the at least one of the gable roof forming panels so as to surround the first half-cut portion. Accordingly, in addition to a way of forming the pouring spout, the liquid content stored in the paper container can be drawn out through a straw.

Advantageous Effects of Invention

As described above, according to the paper container of the present invention, there can be obtained the paper container, which allows the upper end portion of the body panel to be reliably dented by a small force at the time of unsealing so as to be easily unsealed, and causes no fear in that the paper container is distorted at the time of forming the paper container.

DESCRIPTION OF EMBODIMENTS

Now, a paper container according to an embodiment of the present invention is described in detail with reference to the drawings.

Figure 1:
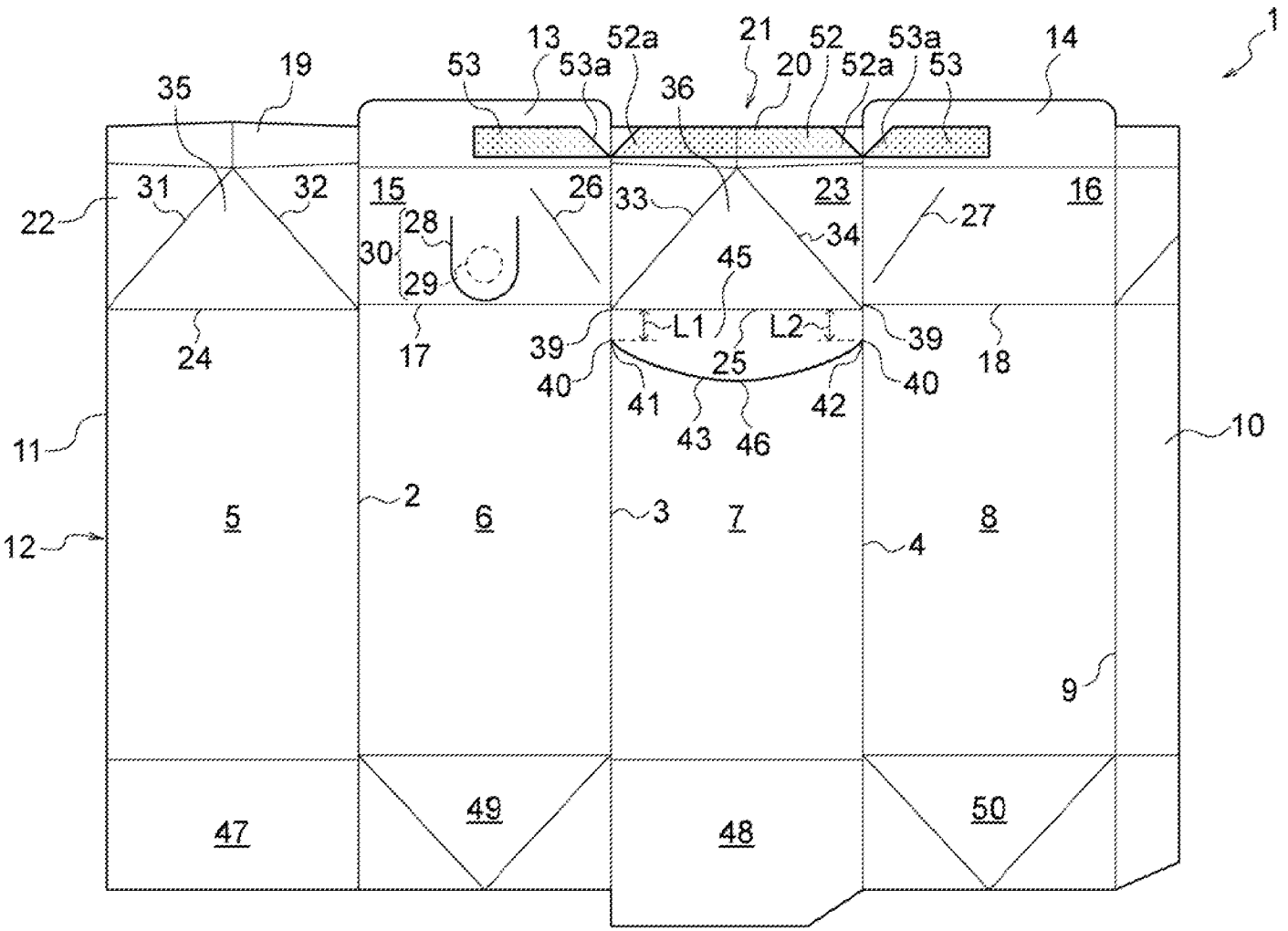
FIG. 1 is a plan view for illustrating a carton blank for a first example of a paper container according to an embodiment of the present invention.
Figure 2:
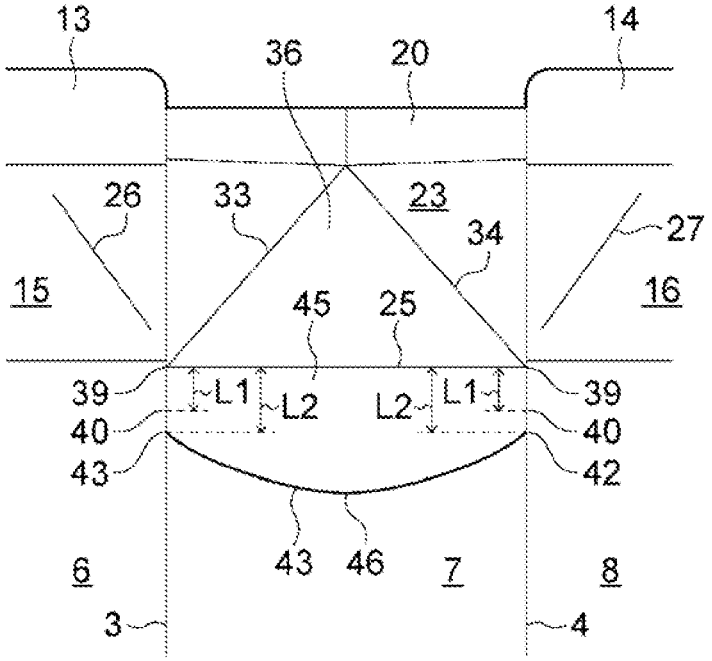
FIG. 2 is an explanatory view for illustrating another example of arrangement positions of end portions of a first auxiliary folding line illustrated in FIG. 1.
Figure 5:
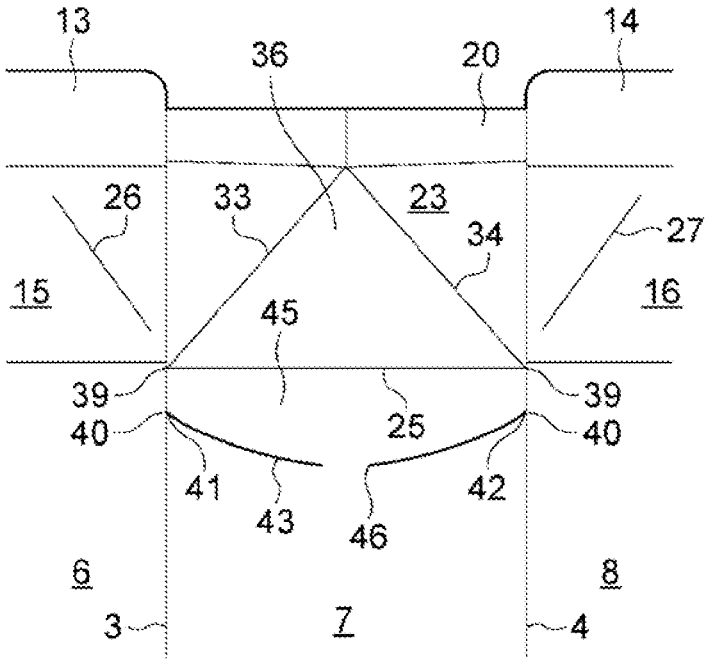
FIG. 5 is an explanatory view for illustrating another example of the shape of the first auxiliary folding line illustrated in FIG. 1.
Figure 6:
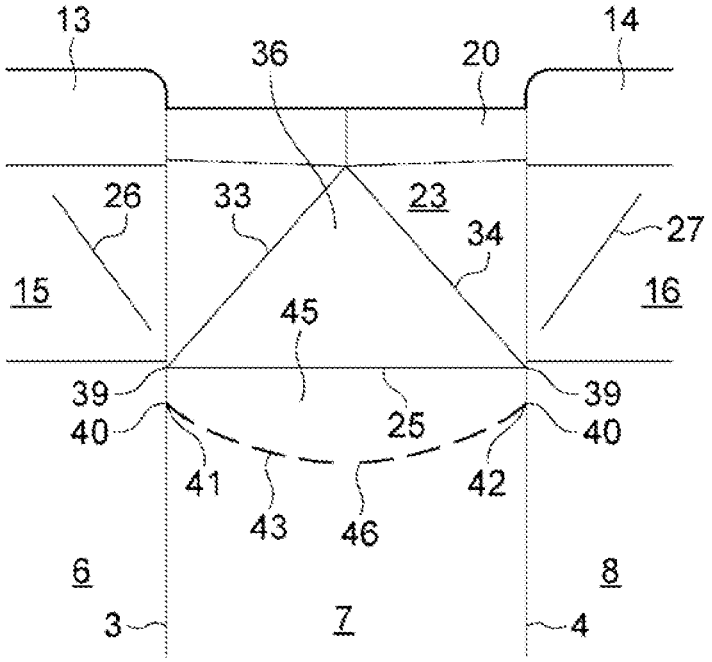
FIG. 6 is an explanatory view for illustrating another example of the shape of the first auxiliary folding line illustrated in FIG. 1.
Figure 7:
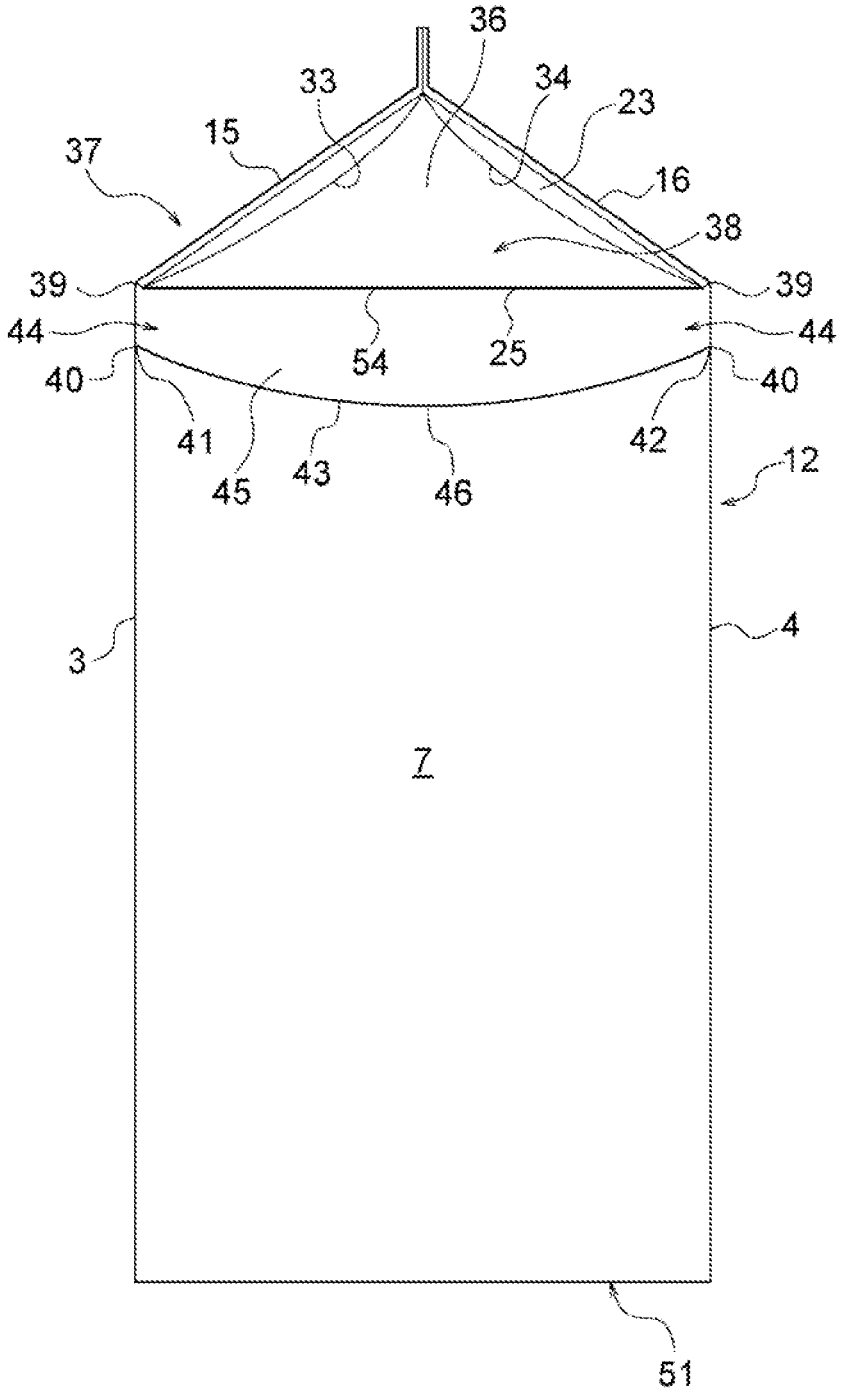
FIG. 7 is a side view for illustrating the paper container formed of the carton blank illustrated in FIG. 1.
Figure 8:
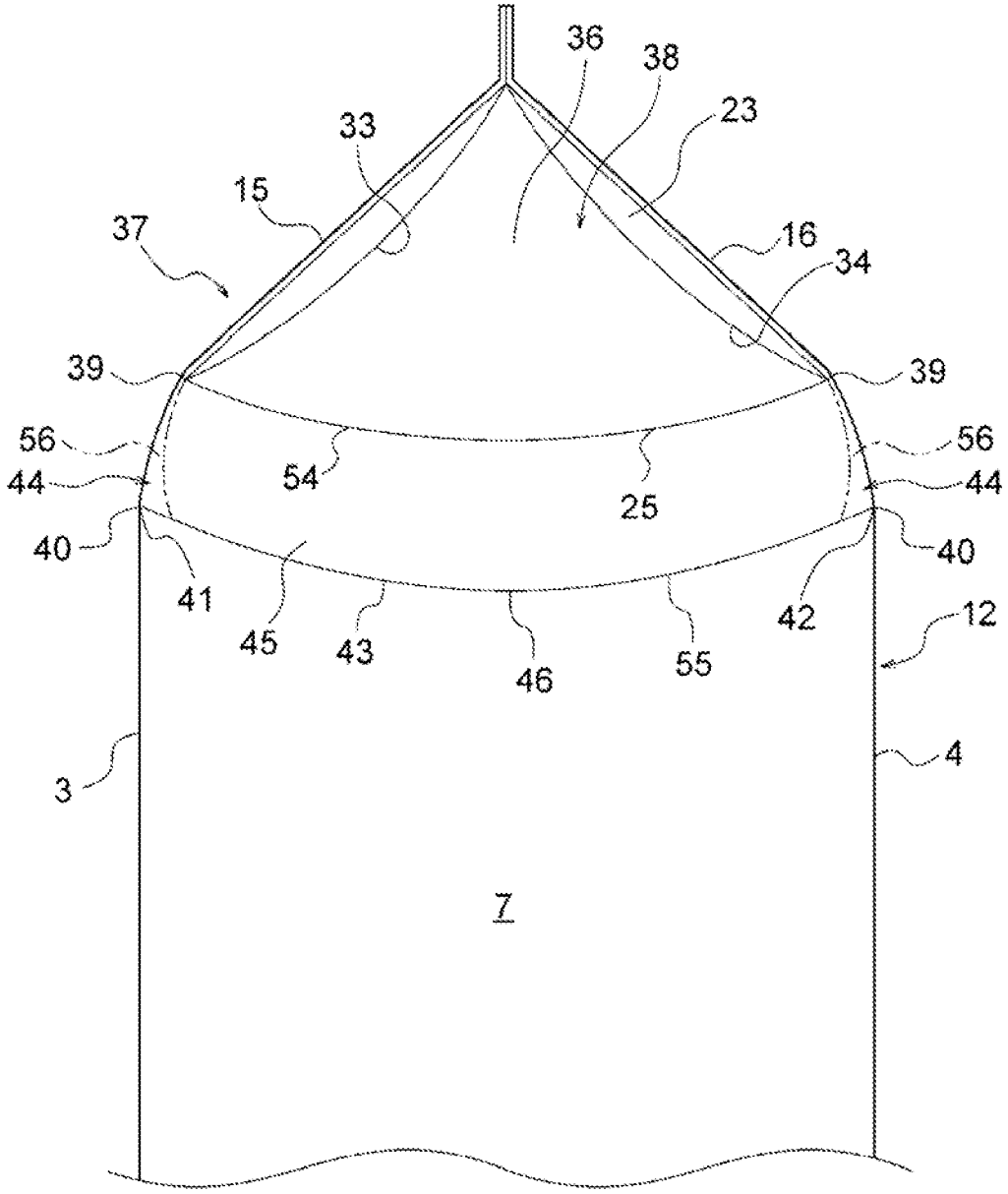
FIG. 8 is an explanatory enlarged side view for illustrating a state in which the paper container illustrated in FIG. 7 is folded along the first auxiliary folding line so that a body is dented.
Figure 9:
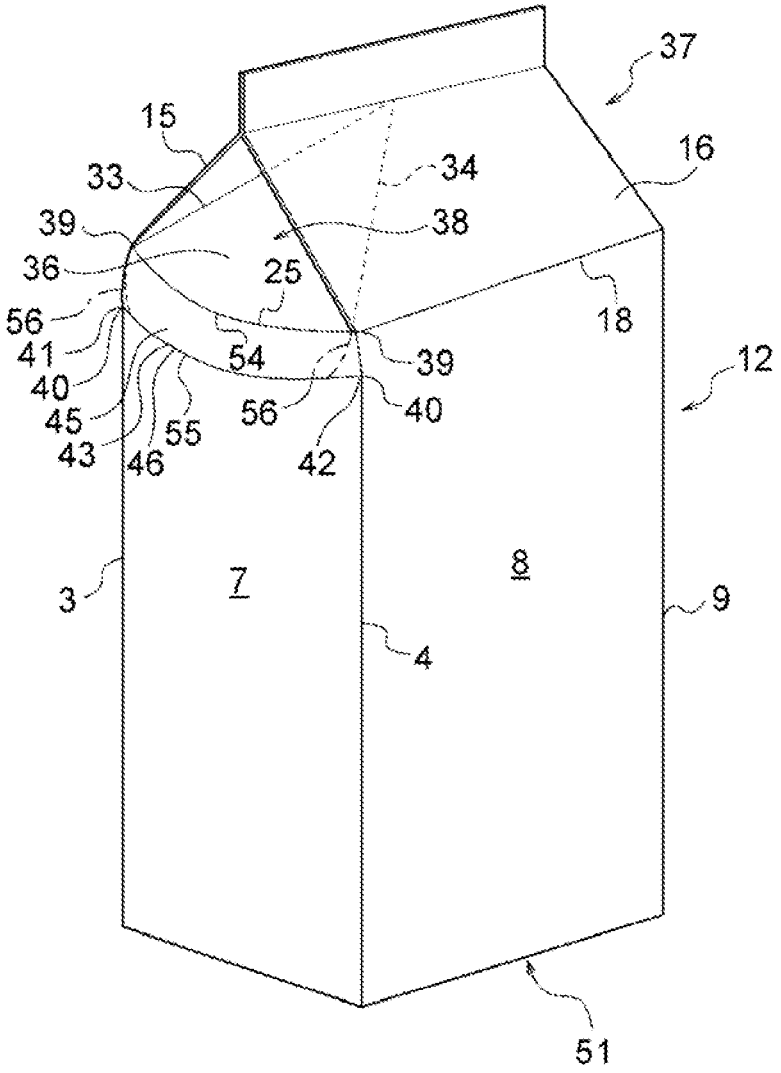
FIG. 9 is a perspective view for illustrating the paper container illustrated in FIG. 8.

FIG. 1 to FIG. 9 are illustrations of a first example of a paper container according to an embodiment of the present invention. FIG. 1 is a plan view for illustrating a carton blank for the first example of the paper container. FIG. 2 is an explanatory view for illustrating another example of arrangement positions of end portions of a first auxiliary folding line illustrated in FIG. 1. FIG. 3, FIG. 4, FIG. 5, and FIG. 6 are each an explanatory view for illustrating another example of a shape of the first auxiliary folding line illustrated in FIG. 1. FIG. 7 is a side view for illustrating the paper container formed of the carton blank illustrated in FIG. 1. FIG. 8 is an explanatory enlarged side view for illustrating a state in which the paper container illustrated in FIG. 7 is folded along the first auxiliary folding line so that a body is dented. FIG. 9 is a perspective view for illustrating the paper container illustrated in FIG. 8.

The paper container in the first example is formed of a carton blank 1 that is a paperboard material illustrated in FIG. 1 having a thermoplastic resin laminated on each of a front surface and a back surface thereof. The carton blank 1 includes four body panels 5, 6, 7, and 8 contiguous with each other through body vertical folding lines 2, 3, and 4. At the time of forming the paper container, a vertical direction sealing panel 10 contiguous with the body panel 8 through a body vertical folding line 9 is joined to an edge portion 11 of the body panel 5 so that the four body panels 5, 6, 7, and 8 form a quadrangular tubular body 12 of the paper container.

A pair of gable roof forming panels 15 and 16 are contiguous with an upper end of the body panel 6 and an upper end of the body panel 8 through top portion horizontal folding lines 17 and 18. The pair of gable roof forming panels 15 and 16 include outer-side top sealing panels 13 and 14 at upper portions thereof, respectively, and are opposed to each other. Further, a pair of gable wall forming panels 22 and 23 are contiguous with an upper end of the body panel 5 and an upper end of the body panel 7 through top portion horizontal folding lines 24 and 25. The pair of gable wall forming panels 22 and 23 include inner-side top sealing panels 19 and 20 at upper portions thereof, respectively, and are opposed to each other. Any one of the pair of gable wall forming panels 22 and 23 is formed into a pouring spout 21 and unsealed. In the first example, the gable wall forming panel 23 serves as an unsealed-side gable wall forming panel.

Guide folding lines 26 and 27 are formed on portions of the gable roof forming panels 15 and 16 on the unsealed-side gable wall forming panel 23 side, respectively. Along the guide folding lines 26 and 27, folding of the gable roof forming panels 15 and 16 is guided at the time of unsealing. Further, a pouring spout 30 for a straw is formed in the gable roof forming panel 15. The pouring spout 30 for a straw includes a first half-cut portion 29 formed on a back surface side of the gable roof forming panel 15 so as to serve as a straw slot, and a second half-cut portion 28 formed on a front surface side of the gable roof forming panel 15 so as to surround the first half-cut portion 29.

Tuck-in folding lines 31, 32, 33, and 34 are formed on the gable wall forming panels 22 and 23, and the gable wall forming panels 22 and 23 are folded in along the tuck-in folding lines 31, 32, 33, and 34. Further, the gable wall forming panel 22 includes a substantially triangular surface portion 35 surrounded by the tuck-in folding lines 31 and 32 and the top portion horizontal folding line 24, and the gable wall forming panel 23 includes a substantially triangular surface portion 36 surrounded by the tuck-in folding lines 33 and 34 and the top portion horizontal folding line 25.

At the time of forming the paper container, the pair of gable wall forming panels 22 and 23 are folded between the pair of gable roof forming panels 15 and 16, and the outer-side top sealing panels 13 and 14 and the inner-side top sealing panels 19 and 20 are heated, sealed, and tightly closed at predetermined positions, thereby forming a gable roof-shaped top portion 37 in the paper container as illustrated in FIG. 7. In the gable roof-shaped top portion 37 thus formed, a space 38 is defined to have an opening between the pair of gable roof forming panels 15 and 16, the unsealed-side body panel 7, and the unsealed-side gable wall forming panel 23. The space 38 allows fingers to be inserted thereinto in order that the fingers are put on the unsealed-side gable wall forming panel 23 at the time of unsealing of the paper container. The substantially triangular surface portion 36 formed on the gable wall forming panel 23 is located on a deep plane of the space 38.

Further, in the carton blank 1, reference points 40 are respectively set on the body vertical folding lines 3 and 4 that are located on both sides of the unsealed-side body panel 7 contiguous with the unsealed-side gable wall forming panel 23 through the top portion horizontal folding line 25. Each of the reference points 40 is distant by a length L1 of 3 mm or more from an intersection 39 of an end portion of each of the body vertical folding lines 3 and 4 and an end portion of the top portion horizontal folding line 25.

On the body panel 7, a first auxiliary folding line 43 having an upwardly curved shape is formed to have end portions 41 and 42 arranged on the body vertical folding lines 3 and 4, respectively. The end portions 41 and 42 of the first auxiliary folding line 43 are arranged so as to connect the reference points 40 to each other, or connect together positions that are near the reference points 40 and below the reference points 40 on the body vertical folding lines 3 and 4 in a height direction of each of the body vertical folding lines 3 and 4. The end portions 41 and 42 of the first auxiliary folding line 43 are each distant from the intersection 39 by 3 mm or more and by a range within a length L2 equal to or smaller than 20% of a length of the top portion horizontal folding line 25.

In a case in which the length L1 is smaller than 3 mm, when pressure is applied to mountain-fold the carton blank along the top portion horizontal folding line 25 at the time of formation of the gable roof-shaped top portion 37 of the paper container to be described later, bending load bearing portions 44 are buckled by a small force. Thus, the carton blank is mountain-folded along the first auxiliary folding line 43 and distorted so that a defective product is produced in some cases. Further, in a case in which the length L2 is larger than 20% of the length of the top portion horizontal folding line 25, when the paper container is unsealed, the bending load bearing portions 44 are not easily buckled, and a large force accompanied with trouble is required in some cases.

It is only required that the length L1 from the reference point 40 to the intersection 39 be equal to or larger than 3 mm, but it is preferred that the length L1 be from 3 mm to 4 mm. Further, it is only required that the length from each of the end portions 41 and 42 of the first auxiliary folding line 43 to the intersection 39 be equal to or larger than 3 mm and within the length L2 equal to or smaller than 20% of the length of the top portion horizontal folding line 25. However, it is preferred that the length L2 be from 5 mm to 6 mm.

With this, the bending load bearing portions 44 in the body panel 7 between the top portion horizontal folding line 25 and the end portions 41 and 42 of the first auxiliary folding line 43 are not easily buckled by a small force. Thus, there can be more effectively prevented the following situation: when pressure is applied to mountain-fold the carton blank along the top portion horizontal folding line 25 at the time of formation of the gable roof-shaped top portion 37 of the paper container, a force is transmitted to the first auxiliary folding line 43, and the carton blank is mountain-folded along the first auxiliary folding line 43 and distorted so that a defective product is produced. In addition, at the time of unsealing of the paper container, buckling is caused without requiring a large force, thereby being capable of easily unsealing the paper container.

In the first example, the first auxiliary folding line 43 having an upwardly curved shape is formed on the body panel 7 to have the end portions 41 and 42 that are arranged so as to connect the reference points 40 to each other. Accordingly, in the first example, the length L1 is equal to the length L2.

FIG. 2 is an illustration of another example of the end portions 41 and 42 of the first auxiliary folding line 43 of the body panel 7 arranged on the body vertical folding lines 3 and 4, respectively. The end portions 41 and 42 are arranged so as to connect together the positions that are near the reference points 40 and below the reference points 40 on the body vertical folding lines 3 and 4 in the height direction.

When a top-portion corner portion 54 of the tubular body 12 is pushed in toward an inner side of the paper container at the time of unsealing of the paper container to be described later, along the first auxiliary folding line 43, the body panel 7 is mountain-folded. When the body panel 7 is mountain-folded along the first auxiliary folding line 43, the bending load bearing portions 44 of the body panel 7 between the top portion horizontal folding line 25 and the end portions 41 and 42 of the first auxiliary folding line 43 are buckled, and an upper end portion 45 of the body panel 7 is dented, thereby curving the top-portion corner portion 54 of the tubular body 12 toward the inner side of the paper container.

Figure 3:
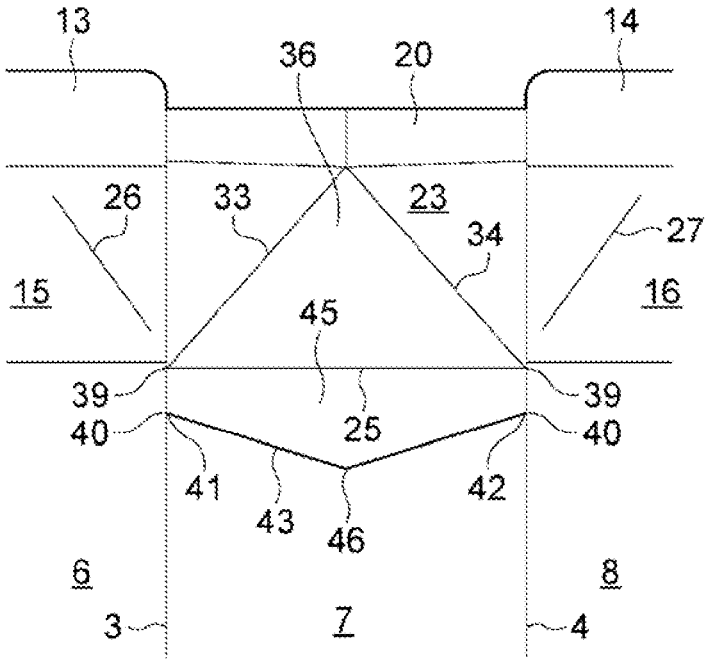
FIG. 3 is an explanatory view for illustrating another example of a shape of the first auxiliary folding line illustrated in FIG. 1.
Figure 4:
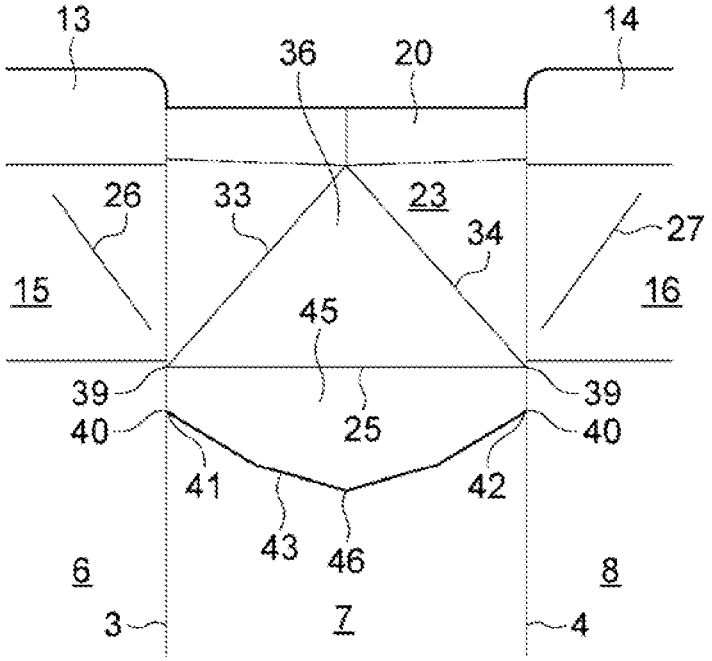
FIG. 4 is an explanatory view for illustrating another example of the shape of the first auxiliary folding line illustrated in FIG. 1.

Further, the upwardly curved shape of the first auxiliary folding line 43 may be an arc shape or an angled curve shape. In the first example, the first auxiliary folding line 43 is a continuous line having an arc shape. However, for example, as illustrated in FIG. 3, the first auxiliary folding line 43 may be a V-shaped line having an angled curve shape. Alternatively, the first auxiliary folding line 43 may be a polygonal line having an angled curve shape as illustrated in FIG. 4, or may be intermittent and discontinuous lines as illustrated in FIG. 5 and FIG. 6.

Further, in the first example, the first auxiliary folding line 43 is shaped so that a lowermost point 46 of the upward curve is located at a center of the body panel 7 in a right-and-left direction of the body panel 7. Accordingly, the top-portion corner portion 54 of the tubular body 12 can be easily pushed in from a center portion of the top-portion corner portion 54 toward the inner side of the paper container.

Further, in the first example, the first auxiliary folding line 43 is formed so as to be symmetrical. With this configuration, the space 38 can be expanded symmetrically, and hance the space 38 can have a shape allowing fingers to be more easily inserted thereinto.

Further, in the first example, bottom forming panels 47 and 48 are contiguous with a lower end of the body panel 5 and a lower end of the body panel 7, respectively, and inner panels 49 and 50 are contiguous with a lower end of the body panel 6 and a lower end of the body panel 8, respectively. The inner panels 49 and 50 are folded within the bottom forming panels 47 and 48, and abutment surfaces of the panels are bonded together so as to close a bottom portion of the tubular body 12, thereby forming a bottom portion 51 of the paper container. The configuration of the bottom portion 51 is not limited to the configuration in the first example. As long as the bottom portion of the tubular body 12 can be closed, there can be adopted another configuration of the bottom portion that is publicly-known in the field of the paper container.

Further, in the first example, as illustrated in FIG. 1, the inner-side top sealing panel 20 is contiguous with an upper portion of the gable wall forming panel 23 that is to be formed into the pouring spout 21 and unsealed, and the inner-side top sealing panel 20 has a straight upper side.

Further, a first easily-separable region 52 is formed on an inner surface of the inner-side top sealing panel 20. A second easily-separable region 53, which is to be superposed on the first easily-separable region 52, is formed on a portion of an inner surface of each of the outer-side top sealing panels 13 and 14 on a side closer to the inner-side top sealing panel 20 so as to cover almost half of each of the outer-side top sealing panels 13 and 14 in a lateral length direction thereof. The outer-side top sealing panels 13 and 14 are located on both sides of the inner-side top sealing panel 20, and are contiguous with upper portions of the pair of gable roof forming panels 15 and 16.

As long as sealability to prevent liquid leakage can be maintained, a position and a region surface contour of the first easily-separable region 52 formed on the inner surface of the inner-side top sealing panel 20, and positions and region surface contours of the second easily-separable regions 53 formed on the inner surfaces of the outer-side top sealing panels 13 and 14 are not particularly limited.

In this example, the first easily-separable region 52 is formed such that an end sealing region having a predetermined lateral width is left at each end of the inner-side top sealing panel 20 in a lateral length direction thereof. The second easily-separable region 53 is formed such that an end sealing region having a predetermined lateral width is left at a portion of each of the outer-side top sealing panels 13 and 14 on the side closer to the inner-side top sealing panel 20. The first easily-separable region 52 includes extended portions 52*a*. The extended portions 52*a* are respectively formed at both end portions of the first easily-separable region 52 so as to extend in an inclined manner from an upper side to a lower side of the first easily-separable region 52 so that lateral widths become larger toward the body panel 7. The second easily-separable region 53 includes an extended portion 53*a*. The extended portion 53*a* is formed at an end portion of the second easily-separable region 53 on the side closer to the inner-side top sealing panel 20 so as to extend in an inclined manner from an upper side to a lower side of the second easily-separable region 53 so that a lateral width becomes larger toward the body panel 6 or the body panel 8.

Further, a lateral width of each of the body panels 5, 6, 7, and 8, which is one of factors for determining a size of the paper container, and a basis weight of the paperboard material for forming the paper container are not particularly limited. However, in the first example, the lateral width of each of the body panels 5, 6, 7, and 8 is set to 57 mm or less, and the basis weight of the paperboard material is set to from 150 g/m$^2$ to 250 g/m$^2$.

The paper container described above is unsealed as follows.

First, the top-portion corner portion 54 formed by folding the carton blank along the top portion horizontal folding line 25 is pressed so as to be pushed in toward the inner side of the paper container. In this manner, as the top-portion corner portion 54 is pushed in toward the inner side of the paper container, an interior angle of the top-portion corner portion 54 becomes larger, and the upper end portion 45 of the body panel 7 is deformed so as to protrude toward an outer side of the paper container so that a protruding amount becomes larger from the top-portion corner portion 54 toward a lower side of the body panel 7. Then, when a force of a certain magnitude or more is applied, the paper container is mountain-folded along the first auxiliary folding line 43, and thus a protruding portion 55 protruding outward is formed along the first auxiliary folding line 43. As a result, in each bending load bearing portion 44 of the upper end portion 45, a buckle 56 (indicated by the dot-and-dash line in FIG. 8 and FIG. 9) appears in a form of a folding line connecting the end portion 41 or the end portion 42 of the first auxiliary folding line 43, or a portion near the end portion 41 or the end portion 42 to the intersection 39.

Then, the top-portion corner portion 54 is curved toward the inner side of the paper container, and the upper end portion 45 of the body panel 7 and the substantially triangular surface portion 36, which forms the deep plane of the space 38, are dented toward the inner side of the paper container. In this manner, a base of the opening of the space 38 extends to a position of the first auxiliary folding line 43, and a volume of the space 38 is also increased by an amount corresponding to dents of the upper end portion 45 and the substantially triangular surface portion 36, thereby defining the space 38 allowing fingers to be easily inserted thereinto at the time of unsealing.

A mode and a position of the buckle 56 that appears in the upper end portion 45 of the body panel 7 are not fixed, and are not limited to positions illustrated in FIG. 8 and FIG. 9.

Then, fingers are inserted into the expanded space 38, and the fingers are put on the unsealed-side gable wall forming panel 23. The gable wall forming panel 23 and the pair of gable roof forming panels 15 and 16 are spread out laterally so as to separate surfaces of the inner-side top sealing panel 20 opposed to the outer-side top sealing panels 13 and 14. Then, the gable wall forming panel 23 folded between the pair of gable roof forming panels 15 and 16 is pulled so as to form the pouring spout 21. Thus, the paper container is unsealed.

According to the first example of the paper container configured as described above, in the unsealed-side body panel 7 contiguous with the unsealed-side gable wall forming panel 23 through the top portion horizontal folding line 25, on each of the body vertical folding lines 3 and 4, the reference point 40 is set so as to be distant by the length L1 of 3 mm or more from the intersection 39 of the end portion of each of the body vertical folding lines 3 and 4 and the end portion of the top portion horizontal folding line 25. The first auxiliary folding line 43 having an upwardly curved shape is formed to have the end portions 41 and 42 that are arranged on the body vertical folding lines 3 and 4, respectively. The end portions 41 and 42 of the first auxiliary folding line 43 are arranged so as to connect the reference points 40 to each other, or connect together the positions that are near the reference points 40 and below the reference points 40 on the body vertical folding lines 3 and 4 in the height direction. Each of the end portions 41 and 42 of the first auxiliary folding line 43 is distant from the intersection 39 by 3 mm or more and by a range within the length L2 equal to or smaller than 20% of the length of the top portion horizontal folding line 25. Accordingly, when pressure is applied to mountain-fold the carton blank along the top portion horizontal folding line 25 at the time of formation of the gable roof-shaped top portion 37 of the paper container, the bending load bearing portions 44 between the top portion horizontal folding line 25 and the end portions 41 and 42 of the first auxiliary folding line 43 can be prevented from being buckled by a small force. In addition, there can be prevented a situation in which a large force accompanied with trouble is required for buckling.

Accordingly, when pressure is applied to mountain-fold the carton blank along the top portion horizontal folding line 25 at the time of formation of the gable roof-shaped top portion 37 of the paper container, the bending load bearing portions 44 between the top portion horizontal folding line 25 and the end portions 41 and 42 of the first auxiliary folding line 43 are not buckled by a small force. Thus, there can be effectively prevented a situation in which the carton blank is mountain-folded along the first auxiliary folding line 43 and distorted so that a defective product is produced.

Further, at the time of unsealing of the paper container, the bending load bearing portions 44 between the top portion horizontal folding line 25 and the end portions 41 and 42 of the first auxiliary folding line 43 are buckled without requiring a large force. Accordingly, the top-portion corner portion 54 of the tubular body 12 can be easily pushed in, and the upper end portion 45 of the body panel 7 can be dented. When the upper end portion 45 of the body panel 7 is dented, the top-portion corner portion 54 is curved toward the inner side of the container. As a result, the space into which fingers are to be inserted when the fingers are put on the gable wall forming panel at the time of unsealing is expanded, thereby being capable of easily unsealing the paper container.

Further, owing to buckles of the bending load bearing portions 44 in the body panel 7 between the top portion horizontal folding line 25 and the end portions 41 and 42 of the first auxiliary folding line 43, deformed portions function as dampers, and can keep the dented state of the upper end portion 45 of the body panel 7. Accordingly, the paper container can be easily unsealed.

Further, the shape of the first auxiliary folding line 43 having an upwardly curved shape is an arc shape, a V shape, a polygonal shape, or a combination of those shapes. Accordingly, at the time of unsealing of the paper container, when the top-portion corner portion 54 of the tubular body 12, which is formed by folding the carton blank along the top portion horizontal folding line 25, or a vicinity of the top-portion corner portion 54 is pushed in, the upper end portion 45 of the body panel 7 can be easily mountain-folded along the first auxiliary folding line 43, thereby being capable of easily denting the upper end portion of the body panel.

Further, the lowermost point 46 of the curve of the first auxiliary folding line 43 is located at the center of the body panel 7 in the right-and-left direction. Accordingly, the top-portion corner portion 54 of the tubular body 12 can be easily pushed in from the center portion of the top-portion corner portion 54 toward the inner side of the paper container.

Further, the first auxiliary folding line 43 is formed so as to be symmetrical. Accordingly, the space 38 expanded by denting the upper end portion 45 of the body panel 7 has a symmetrical shape, and hence the space 38 can have a shape allowing fingers to be easily inserted thereinto.

Further, the inner-side top sealing panel 20 has the straight upper side. Accordingly, sealing areas are small between the inner-side top sealing panel 20 and the outer-side top sealing panels 13 and 14, which are located on both sides of the inner-side top sealing panel 20, thereby being capable of easily separating the inner-side top sealing panel 20 and the outer-side top sealing panels 13 and 14 from each other.

Further, the first easily-separable region 52 is formed on the inner surface of the inner-side top sealing panel 20. The second easily-separable region 53, which is to be superposed on the first easily-separable region 52, is formed on the portion of the inner surface of each of the outer-side top sealing panels 13 and 14 on the side closer to the inner-side top sealing panel 20 so as to cover almost half of each of the outer-side top sealing panels 13 and 14 in the lateral length direction thereof. The outer-side top sealing panels 13 and 14 are located on the both sides of the inner-side top sealing panel 20. Accordingly, the inner-side top sealing panel 20 and the outer-side top sealing panels 13 and 14 can be easily separated from each other.

In this example, the first easily-separable region 52 is formed such that the end sealing region having a predetermined lateral width is left at each end of the inner-side top sealing panel 20 in the lateral length direction thereof. The second easily-separable region 53 is formed such that the end sealing region having a predetermined lateral width is left at the portion of each of the outer-side top sealing panels 13 and 14 on the side closer to the inner-side top sealing panel 20. The first easily-separable region 52 includes the extended portions 52*a*. The extended portions 52*a* are respectively formed at the both end portions of the first easily-separable region 52 so as to extend in an inclined manner from the upper side to the lower side of the first easily-separable region 52 so that the lateral widths become larger toward the body panel 7. The second easily-separable region 53 includes the extended portion 53*a*. The extended portion 53*a* is formed at the end portion of the second easily-separable region 53 on the side closer to the inner-side top sealing panel 20 so as to extend in an inclined manner from the upper side to the lower side of the second easily-separable region 53 so that the lateral width becomes larger toward the body panel 6 or the body panel 8. Accordingly, inclination directions of upper sides of the extended portions 52*a* of the first easily-separable region 52 and the extended portion 53*a* of the second easily-separable region 53 are along separating directions of the end sealing regions present in the inner-side top sealing panel 20 and the outer-side top sealing panels 13 and 14 when the gable wall forming panels 22 and 23 are pulled. With this configuration, the end sealing regions in the inner-side top sealing panel 20 and the outer-side top sealing panels 13 and 14 can be easily separated from each other, and hence the paper container is easily unsealed.

Further, the pouring spout 30 for a straw is formed in the gable roof forming panel 15. The pouring spout 30 for a straw includes the first half-cut portion 29 formed on the back surface side of the gable roof forming panel 15 so as to serve as a straw slot, and the second half-cut portion 28 formed on the front surface side of the gable roof forming panel 15 so as to surround the first half-cut portion 29. Accordingly, in addition to a way of forming the pouring spout 21, the liquid content stored in the paper container can be drawn out through a straw.

Figure 10:
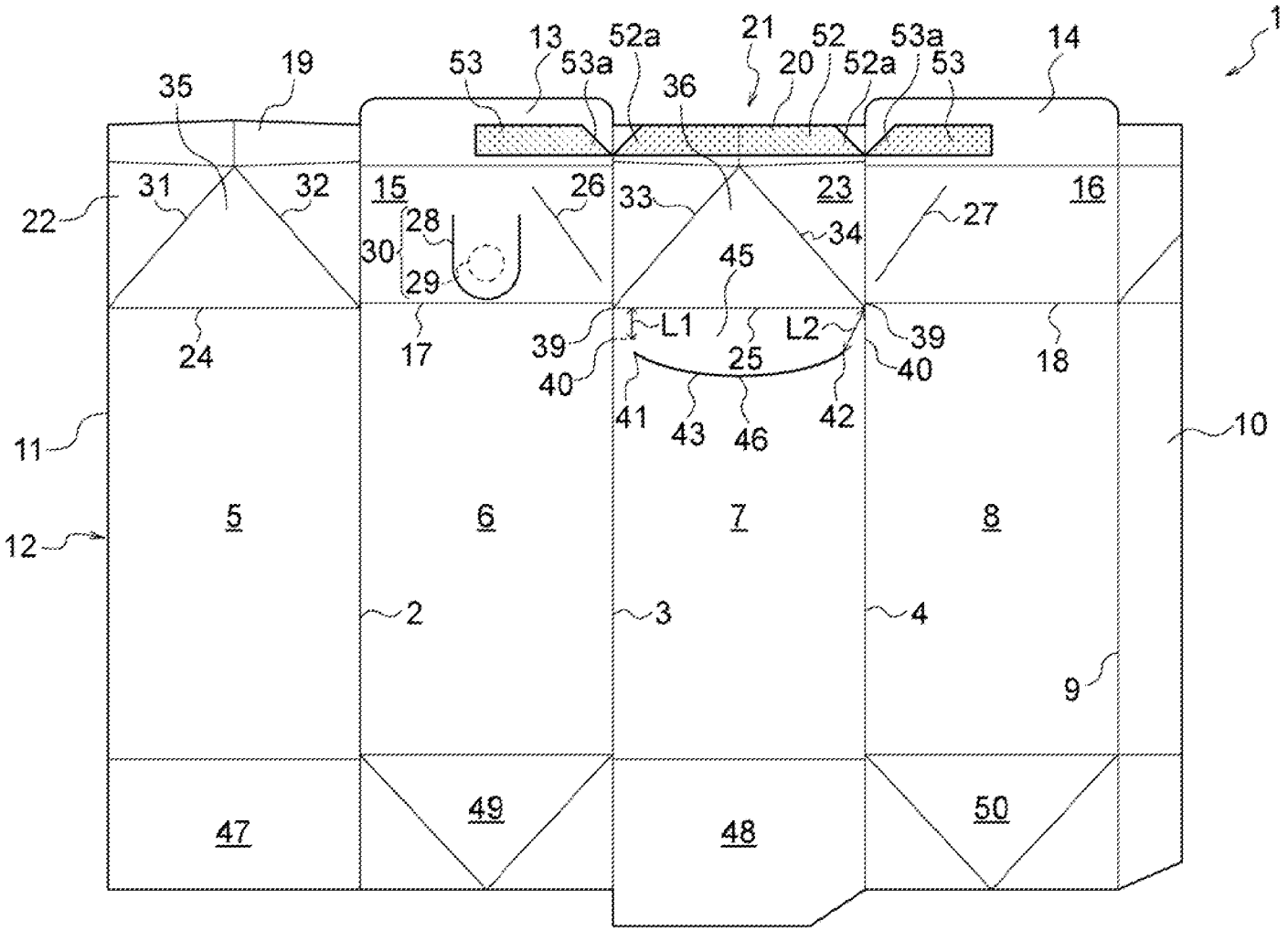
FIG. 10 is a plan view for illustrating a carton blank for a second example of the paper container according to the embodiment of the present invention.
Figure 11:
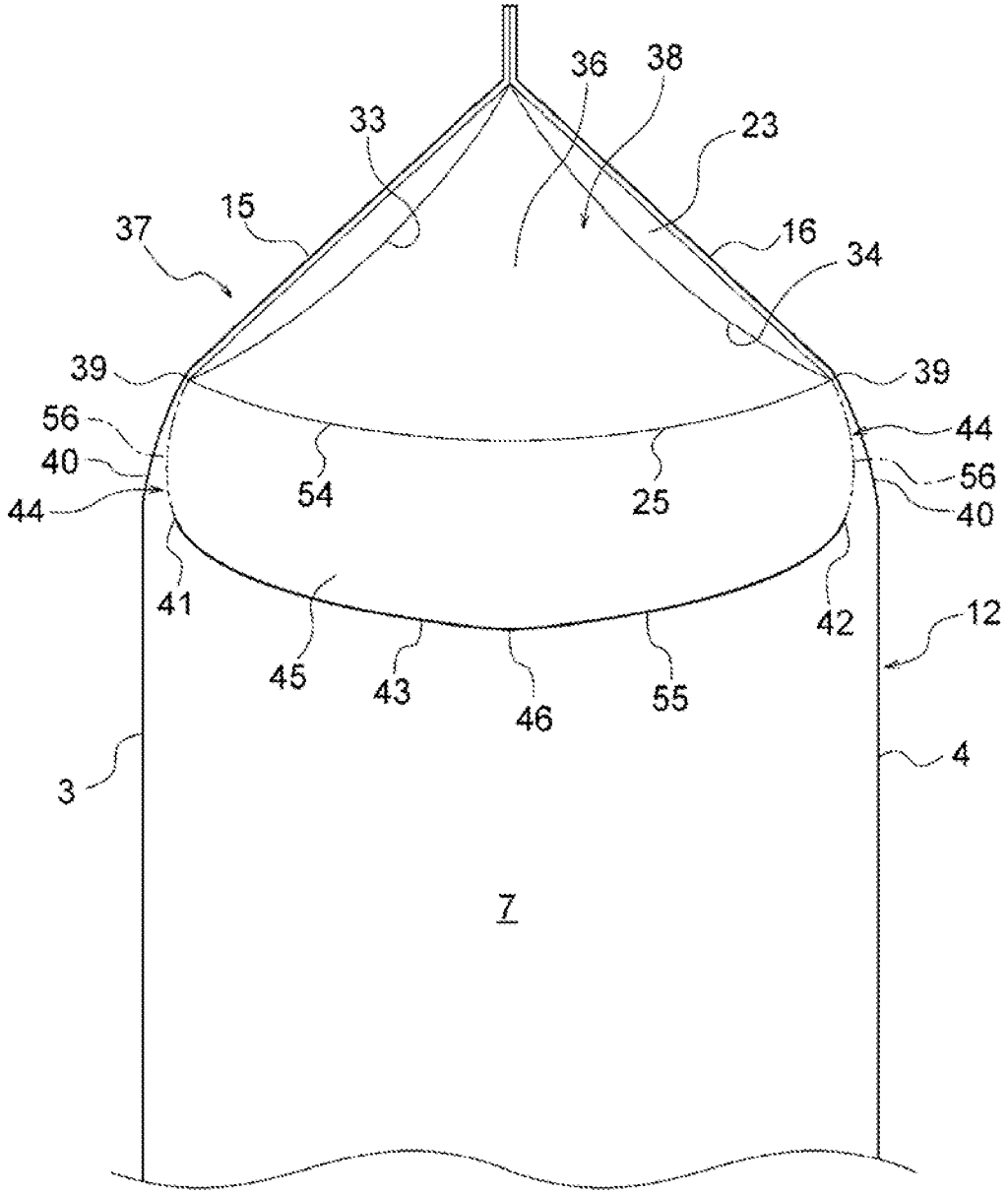
FIG. 11 is an explanatory enlarged side view for illustrating a state in which the paper container formed of the carton blank illustrated in FIG. 10 is folded along the first auxiliary folding line.
Figure 12:
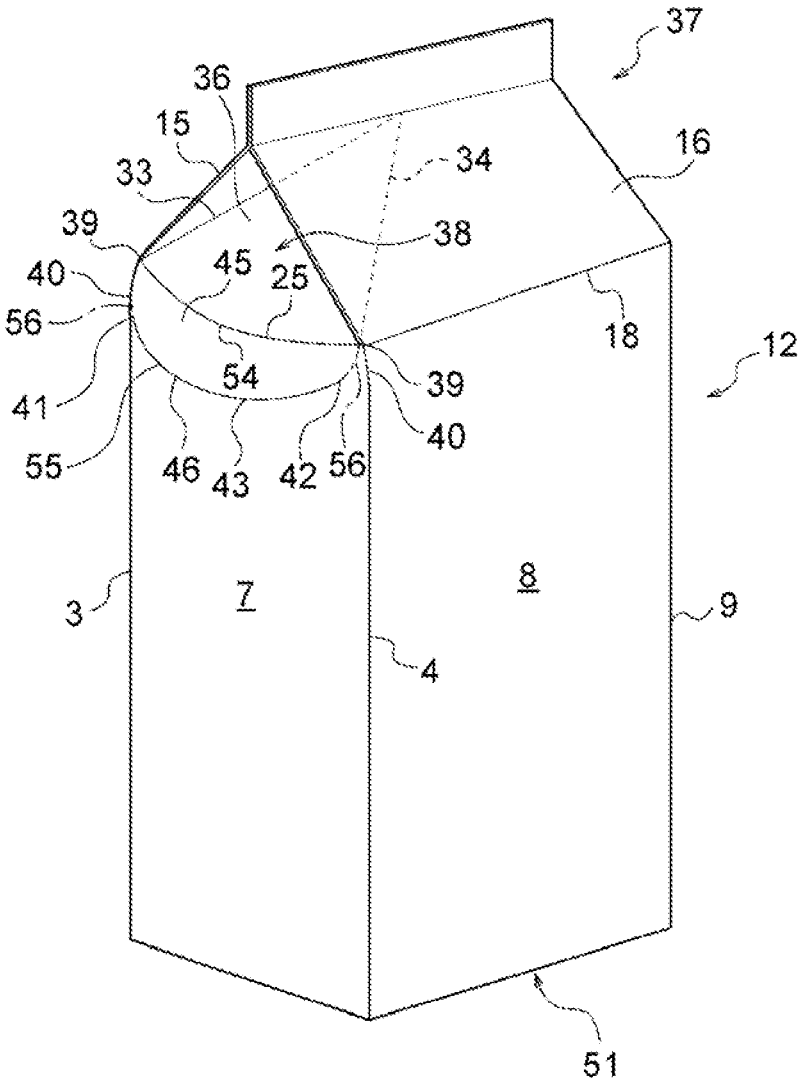
FIG. 12 is a perspective view for illustrating the paper container illustrated in FIG. 11.

FIG. 10 to FIG. 12 are illustrations of a second example of the paper container according to the embodiment of the present invention. FIG. 10 is a plan view for illustrating a carton blank for the second example of the paper container. FIG. 11 is an explanatory enlarged side view for illustrating a state in which the paper container formed of the carton blank illustrated in FIG. 10 is folded along the first auxiliary folding line. FIG. 12 is a perspective view for illustrating the paper container illustrated in FIG. 11.

The second example of the paper container has the same basic configuration as that of the first example of the paper container. In the following description, the same components as those of the first example are denoted by the same reference symbols.

The second example of the paper container is different from the first example of the paper container in terms of positions of the end portions 41 and 42 of the first auxiliary folding line 43. As illustrated in FIG. 10, the first auxiliary folding line 43 in the second example has the end portions 41 and 42 arranged so as to connect together positions that are near the reference points 40, away from the body vertical folding lines 3 and 4, and below the reference points 40 in the height direction.

Similarly to the first example, the reference point 40 is distant from the intersection 39 by the length L1 of 3 mm or more. Further, similarly to the first example, each of the end portions 41 and 42 of the first auxiliary folding line 43 is distant from the intersection 39 by 3 mm or more and by a range within the length L2 equal to or smaller than 20% of the length of the top portion horizontal folding line 25.

Similarly to the first example, in the case in which the length L1 is smaller than 3 mm, when pressure is applied to mountain-fold the carton blank along the top portion horizontal folding line 25 at the time of formation of the gable roof-shaped top portion 37 of the paper container, the bending load bearing portions 44 are buckled by a small force. Thus, the carton blank is mountain-folded along the first auxiliary folding line 43 and distorted so that a defective product is produced in some cases. Further, in the case in which the length L2 is larger than 20% of the length of the top portion horizontal folding line 25, when the paper container is unsealed, the bending load bearing portions 44 are not easily buckled, and a large force accompanied with trouble is required in some cases.

Similarly to the first example, it is only required that the length L1 from the reference point 40 to the intersection 39 be equal to or larger than 3 mm, but it is preferred that the length L1 be from 3 mm to 4 mm. Further, it is only required that the length from each of the end portions 41 and 42 of the first auxiliary folding line 43 to the intersection 39 be equal to or larger than 3 mm and within the length L2 equal to or smaller than 20% of the length of the top portion horizontal folding line 25. However, it is preferred that the length L2 be from 5 mm to 6 mm.

With this, similarly to the first example, the bending load bearing portions 44 in the body panel 7 between the top portion horizontal folding line 25 and the end portions 41 and 42 of the first auxiliary folding line 43 are not easily buckled by a small force. Thus, there can be more effectively prevented the following situation: when pressure is applied to mountain-fold the carton blank along the top portion horizontal folding line 25 at the time of formation of the gable roof-shaped top portion 37 of the paper container, a force is transmitted to the first auxiliary folding line 43, and the carton blank is mountain-folded along the first auxiliary folding line 43 and distorted so that a defective product is produced. In addition, at the time of unsealing of the paper container, buckling is caused without requiring a large force, thereby being capable of easily unsealing the paper container.

The other configurations are the same as those of the first example. Thus, description of the first example is applied to support the second example, and description thereof is omitted.

Similarly to the first example, in the second example, when the paper container is unsealed, first, the top-portion corner portion 54 of the tubular body 12 formed by folding the carton blank along the top portion horizontal folding line 25 is pressed so as to be pushed in toward the inner side of the paper container. In this manner, as the top-portion corner portion 54 is pushed in toward the inner side of the paper container, an interior angle of the top-portion corner portion 54 becomes larger, and the upper end portion 45 of the body panel 7 is deformed so as to protrude toward the outer side of the paper container so that a protruding amount becomes larger from the top-portion corner portion 54 toward the lower side of the body panel 7. Then, when a force of a certain magnitude or more is applied, the paper container is mountain-folded along the first auxiliary folding line 43, and thus the protruding portion 55 protruding outward is formed along the first auxiliary folding line 43. As a result, the buckle 56 (indicated by the dot-and-dash line in FIG. 11 and FIG. 12) appears in a form of a folding line connecting the end portion 41 or the end portion 42 of the first auxiliary folding line 43, or a portion near the end portion 41 or the end portion 42 to the intersection 39. Then, the top-portion corner portion 54 is curved toward the inner side of the paper container, and the upper end portion 45 of the body panel 7 and the substantially triangular surface portion 36, which forms the deep plane of the space 38, are dented toward the inner side of the paper container. In this manner, the space 38 is increased by an amount corresponding to dents of the upper end portion 45 and the substantially triangular surface portion 36, thereby defining the space 38 allowing fingers to be easily inserted thereinto at the time of unsealing.

The other unsealing process is the same as that of the first example. Thus, description of the first example is applied to support the second example, and description thereof is omitted.

According to the second example of the paper container configured as described above, in the unsealed-side body panel 7 contiguous with the unsealed-side gable wall forming panel 23 through the top portion horizontal folding line 25, on each of the body vertical folding lines 3 and 4, the reference point 40 is set so as to be distant by the length L1 of 3 mm or more from the intersection 39 of the end portion of each of the body vertical folding lines 3 and 4 and the end portion of the top portion horizontal folding line 25. The first auxiliary folding line 43 having an upwardly curved shape is formed to have the end portions 41 and 42 that are arranged on the body vertical folding lines 3 and 4, respectively. The end portions 41 and 42 of the first auxiliary folding line 43 are arranged so as to connect together the positions that are near the reference points 40, away from the body vertical folding lines 3 and 4, and below the reference points 40 in the height direction. Each of the end portions 41 and 42 of the first auxiliary folding line 43 is distant from the intersection 39 by 3 mm or more and by a range within the length L2 equal to or smaller than 20% of the length of the top portion horizontal folding line 25. Accordingly, when pressure is applied to mountain-fold the carton blank along the top portion horizontal folding line 25 at the time of formation of the gable roof-shaped top portion 37 of the paper container, the bending load bearing portions 44 between the top portion horizontal folding line 25 and the end portions 41 and 42 of the first auxiliary folding line 43 can be prevented from being buckled by a small force. In addition, there can be prevented the situation in which a large force accompanied with trouble is required for buckling.

Accordingly, similarly to the first example, when pressure is applied to mountain-fold the carton blank along the top portion horizontal folding line 25 at the time of formation of the gable roof-shaped top portion 37 of the paper container, the bending load bearing portions 44 between the top portion horizontal folding line 25 and the end portions 41 and 42 of the first auxiliary folding line 43 are not buckled by a small force. Thus, there can be effectively prevented the situation in which the carton blank is mountain-folded along the first auxiliary folding line 43 and distorted so that a defective product is produced.

Further, at the time of unsealing of the paper container, the bending load bearing portions 44 between the top portion horizontal folding line 25 and the end portions 41 and 42 of the first auxiliary folding line 43 are buckled without requiring a large force. Accordingly, the top-portion corner portion 54 of the tubular body 12 can be easily pushed in, and the upper end portion 45 of the body panel 7 can be dented. When the upper end portion 45 of the body panel 7 is dented, the top-portion corner portion 54 is curved toward the inner side of the container. As a result, the space into which fingers are to be inserted when the fingers are put on the gable wall forming panel at the time of unsealing is expanded, thereby being capable of easily unsealing the paper container.

The other effects are the same as those of the first example. Thus, description of the first example is applied to support the second example, and description thereof is omitted.

Figure 13:
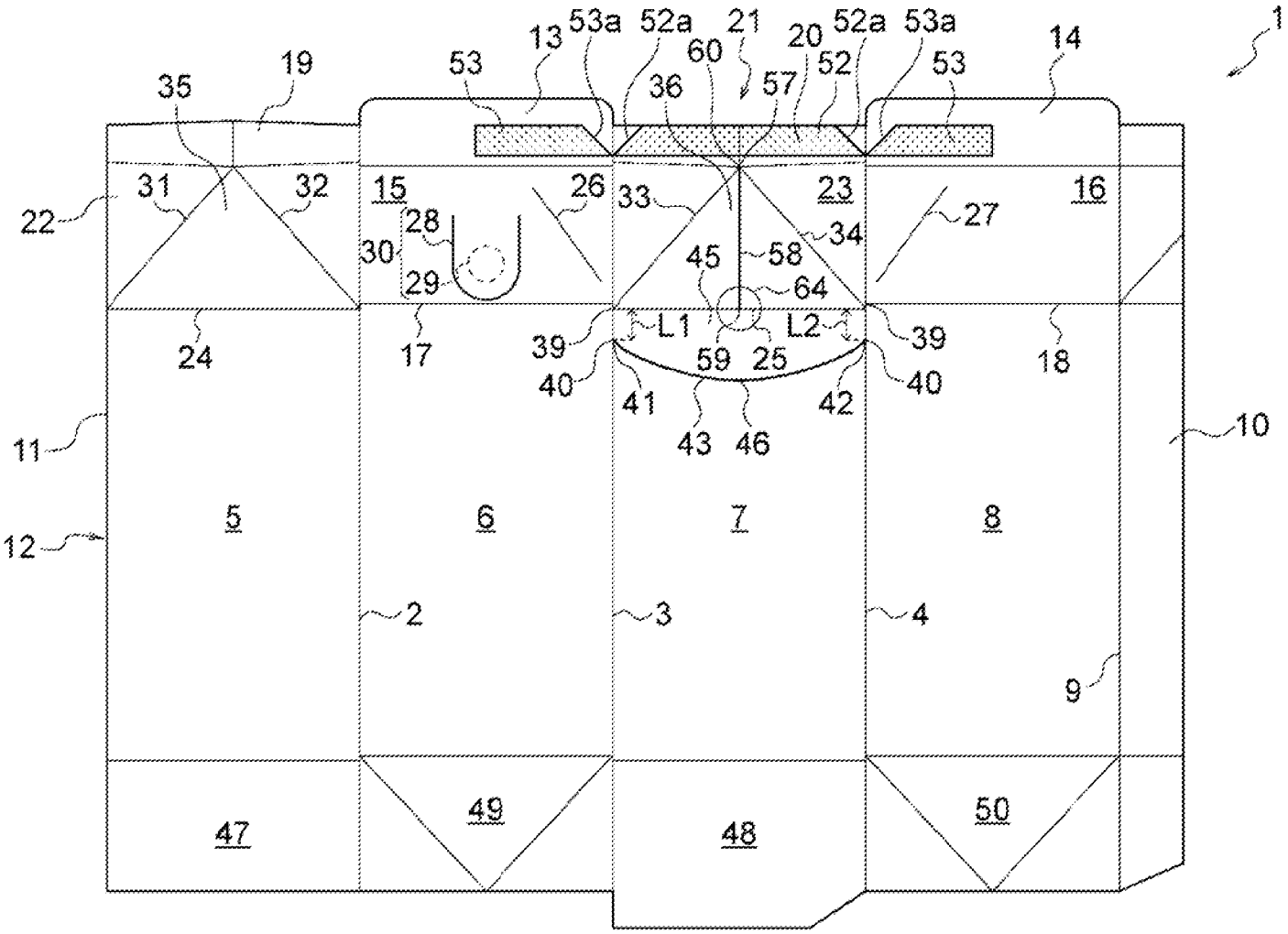
FIG. 13 is a plan view for illustrating a carton blank for a third example of the paper container according to the embodiment of the present invention.
Figure 14:
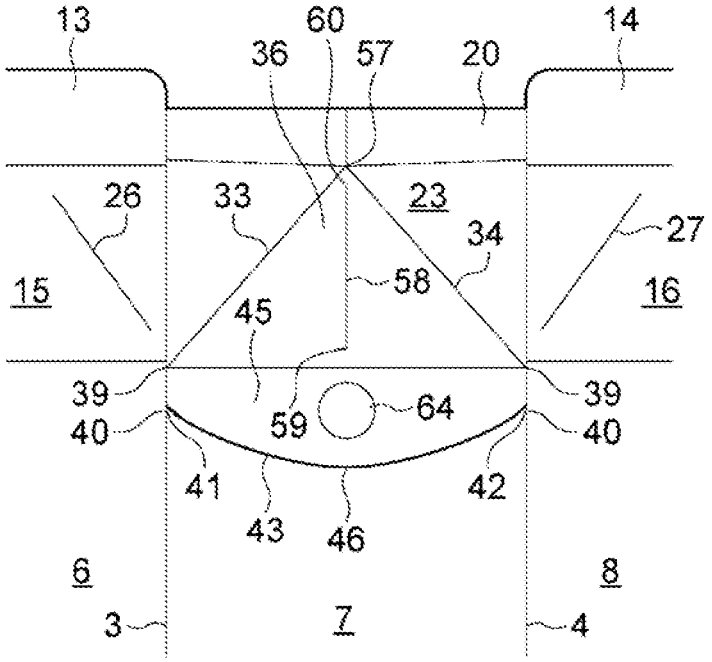
FIG. 14 is an explanatory view for illustrating another example of a shape of a second auxiliary folding line illustrated in FIG. 13.
Figure 15:
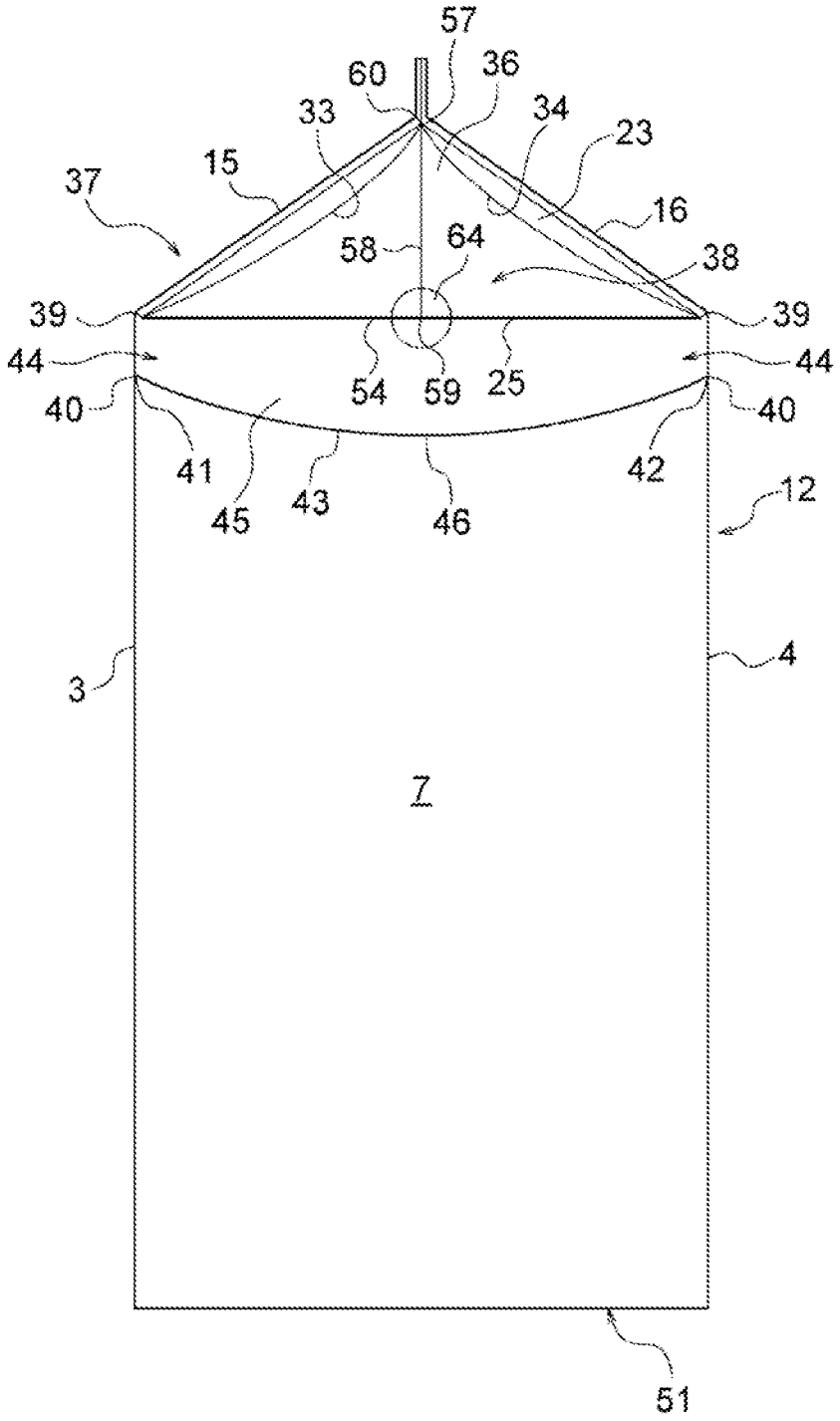
FIG. 15 is a side view for illustrating the paper container formed of the carton blank illustrated in FIG. 13.
Figure 16:
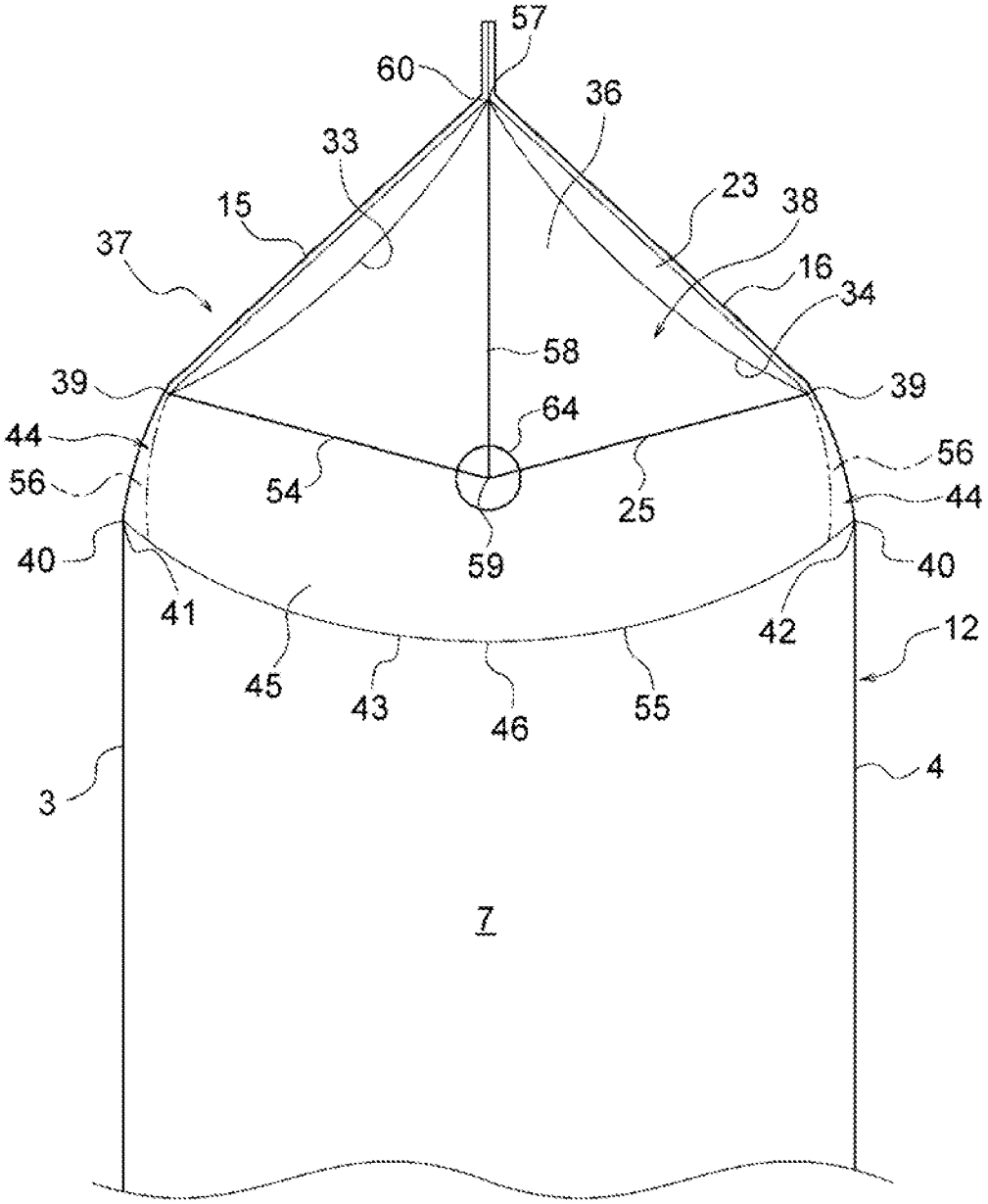
FIG. 16 is an explanatory enlarged side view for illustrating a state in which the paper container illustrated in FIG. 15 is folded along the first auxiliary folding line and the second auxiliary folding line so that the body is dented.
Figure 17:
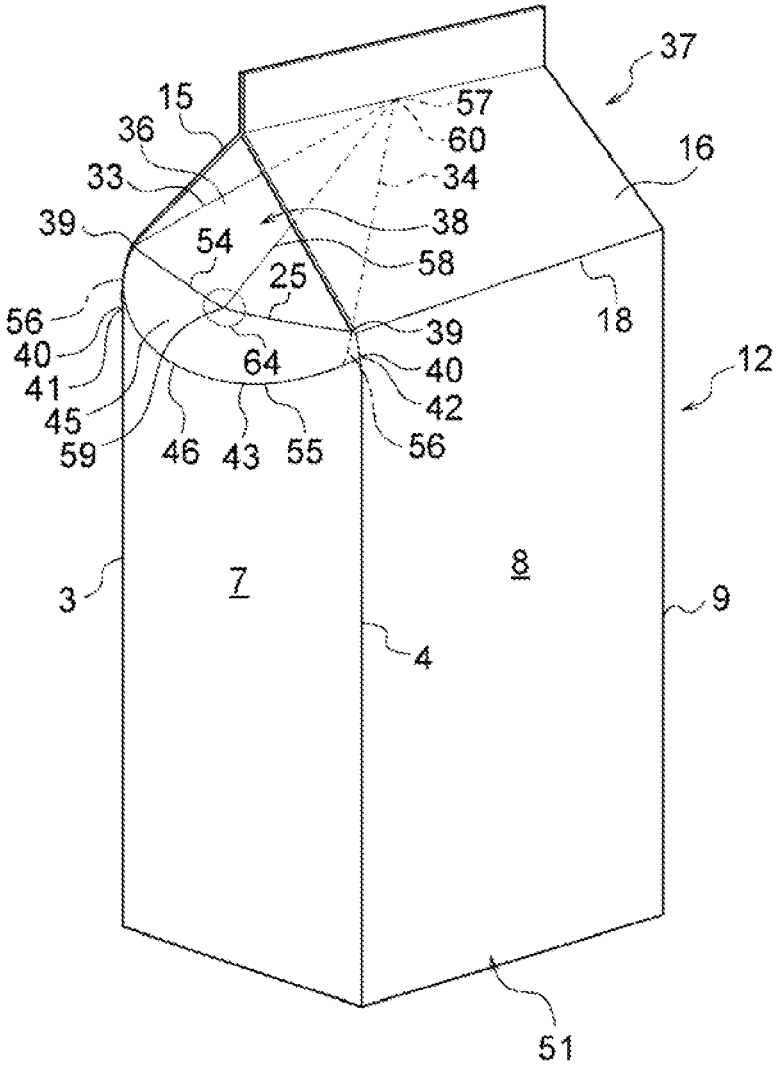
FIG. 17 is a perspective view for illustrating the paper container illustrated in FIG. 16.

FIG. 13 to FIG. 17 are illustrations of a third example of the paper container according to the embodiment of the present invention. FIG. 13 is a plan view for illustrating a carton blank for the third example of the paper container. FIG. 14 is an explanatory view for illustrating another example of a shape of a second auxiliary folding line illustrated in FIG. 13. FIG. 15 is a side view for illustrating the paper container formed of the carton blank illustrated in FIG. 13. FIG. 16 is an explanatory enlarged side view for illustrating a state in which the paper container illustrated in FIG. 15 is folded along the first auxiliary folding line and the second auxiliary folding line so that the body is dented. FIG. 17 is a perspective view for illustrating the paper container illustrated in FIG. 16.

The third example of the paper container has the same basic configuration as that of the first example of the paper container. In the following description, the same components as those of the first example are denoted by the same reference symbols.

The third example of the paper container is different from the first example of the paper container in terms of a second auxiliary folding line 58 formed on the unsealed-side body panel 7 and the substantially triangular surface portion 36 of the unsealed-side gable wall forming panel 23 so as to extend from a direction of the lowermost point 46 at the center portion of the first auxiliary folding line 43 to a direction of a vertex 57 of the substantially triangular surface portion 36 across the top portion horizontal folding line 25.

The shape of the second auxiliary folding line 58 is not particularly limited. However, it is preferred that a lower end portion 59 of the second auxiliary folding line 58 on a side of a center position of the top portion horizontal folding line 25 be located on the center position of the top portion horizontal folding line 25 or in a vicinity of the center position, and that an upper end portion 60 of the second auxiliary folding line 58 on a side of the vertex 57 of the substantially triangular surface portion 36 be located on the vertex 57 of the substantially triangular surface portion 36 or in a vicinity of the vertex 57.

In the third example, the lower end portion 59 of the second auxiliary folding line 58 is located on the center of top portion horizontal folding line 25, and the upper end portion 60 is located on the vertex 57 of the substantially triangular surface portion 36. FIG. 14 is an illustration of another example of the second auxiliary folding line 58. In the second auxiliary folding line 58 illustrated in FIG. 14, the lower end portion 59 is located in the vicinity of the center position of the top portion horizontal folding line 25, and the upper end portion 60 is located in the vicinity of the vertex 57 of the substantially triangular surface portion 36.

Further, although not shown, the lower end portion 59 of the second auxiliary folding line 58 may be located on the center of the top portion horizontal folding line 25, and the upper end portion 60 may be located in the vicinity of the vertex 57 of the substantially triangular surface portion 36. Alternatively, the lower end portion 59 of the second auxiliary folding line 58 may be located in the vicinity of the center position of the top portion horizontal folding line 25, and the upper end portion 60 on the side of the vertex 57 of the substantially triangular surface portion 36 may be located on the vertex 57 of the substantially triangular surface portion 36.

Further, in the third example, the second auxiliary folding line 58 is a straight line, but may be a wavy line or a broken line.

Further, in the third example, as a mark to be used when the top-portion corner portion 54 of the tubular body 12 is pushed in toward the inner side of the paper container at the time of unsealing of the paper container, a point indication 64 for indicating a pushing point is provided on the center portion of the top portion horizontal folding line 25 or in a vicinity of the center portion so as to extend astride the substantially triangular surface portion 36 and the body panel 7 or extend in any one of the substantially triangular surface portion 36 and the body panel 7. In FIG. 13, the point indication 64 is provided on the center portion of the top portion horizontal folding line 25 so as to extend astride the substantially triangular surface portion 36 and the body panel 7. In FIG. 14, the point indication 64 is provided in a vicinity of the top portion horizontal folding line 25 in the body panel 7. In the third example, the point indication 64 is formed by embossing, but is not limited thereto as long as the point indication 64 is recognizable. The point indication 64 may be formed by, for example, printing.

Further, the shape of the point indication 64 is not particularly limited. For example, when the point indication 64 is designed, a design effect of the paper container is exerted.

The other configurations are the same as those of the first example. Thus, description of the first example is applied to support the second example, and description thereof is omitted.

Similarly to the first example, in the third example, when the paper container is unsealed, first, the top-portion corner portion 54 of the tubular body 12 formed by folding the carton blank along the top portion horizontal folding line 25 is pressed so as to be pushed in toward the inner side of the paper container. In this manner, as the top-portion corner portion 54 is pushed in toward the inner side of the paper container, an interior angle of the top-portion corner portion 54 becomes larger, and the upper end portion 45 of the body panel 7 is deformed so as to protrude toward the outer side of the paper container so that a protruding amount becomes larger from the top-portion corner portion 54 toward the lower side of the body panel 7.

In this case, the second auxiliary folding line 58 is formed on the upper end portion 45 of the body panel 7 and the substantially triangular surface portion 36 so as to extend from the direction of the lowermost point 46 at the center portion of the first auxiliary folding line 43 to the direction of the vertex 57 of the substantially triangular surface portion 36 across the top portion horizontal folding line 25. Thus, when the top-portion corner portion 54 is pushed in, the upper end portion 45 of the body panel 7 and the substantially triangular surface portion 36 are valley-folded along the second auxiliary folding line 58 so that the center portion of the top-portion corner portion 54 is guided so as to be folded toward the inner side of the paper container.

When a force of a certain magnitude or more is applied, the paper container is mountain-folded along the first auxiliary folding line 43, and thus the protruding portion 55 protruding outward is formed along the first auxiliary folding line 43. As a result, the buckle 56 (indicated by the dot-and-dash line in FIG. 16 and FIG. 17) appears in a form of a folding line connecting the end portion 41 or the end portion 42 of the first auxiliary folding line 43, or a portion near the end portion 41 or the end portion 42 to the intersection 39.

Then, the top-portion corner portion 54 is bent toward the inner side of the paper container with the center position of the top-portion corner portion 54 being a bending center, and the upper end portion 45 of the body panel 7 and the substantially triangular surface portion 36, which forms the deep plane of the space 38, are dented toward the inner side of the paper container. In this manner, the space 38 is expanded by an amount corresponding to dents of the upper end portion 45 and the substantially triangular surface portion 36, thereby defining the space 38 allowing fingers to be easily inserted thereinto at the time of unsealing.

The other unsealing process is the same as that of the first example. Thus, description of the first example is applied to support the third example, and description thereof is omitted.

According to the third example of the paper container configured as described above, the second auxiliary folding line 58 is formed on the body panel 7 and the substantially triangular surface portion 36 so as to extend from the direction of the lowermost point 46 at the center portion of the first auxiliary folding line 43 to the direction of the vertex 57 of the substantially triangular surface portion 36 across the top portion horizontal folding line 25. Thus, when the top-portion corner portion 54 is pushed in, the upper end portion 45 of the body panel 7 and the substantially triangular surface portion 36 are valley-folded along the second auxiliary folding line 58 so that the center portion of the top-portion corner portion 54 is guided so as to be folded toward the inner side of the paper container. Accordingly, the substantially triangular surface portion 36 and the upper end portion 45 of the body panel 7 can be easily dented.

In particular, in a case in which the lower end portion 59 of the second auxiliary folding line 58 on the side of the lowermost point 46 of the first auxiliary folding line 43 is located on the lowermost point 46 of the first auxiliary folding line 43 or in a vicinity of the lowermost point 46, and the upper end portion 60 on the side of the vertex 57 of the substantially triangular surface portion 36 is located on the vertex 57 of the substantially triangular surface portion 36 or in a vicinity of the vertex 57, when the top-portion corner portion 54 is pushed in, the upper end portion 45 of the body panel 7 and the substantially triangular surface portion 36 are easily valley-folded along the second auxiliary folding line 58. Thus, the center portion of the top-portion corner portion 54 is effectively guided so as to be folded toward the inner side of the paper container. As a result, the substantially triangular surface portion 36 and the upper end portion 45 of the body panel 7 can be further easily dented.

Further, the point indication 64 for indicating a pushing point is provided on the center portion of the top portion horizontal folding line 25 or in the vicinity of the center portion so as to extend astride the substantially triangular surface portion 36 and the body panel 7, or extend in any one of the substantially triangular surface portion 36 and the body panel 7. Thus, at the time of unsealing of the paper container, owing to the point indication 64, the center portion of the top-portion corner portion 54 of the tubular body 12 or a vicinity of the center portion can be reliably pushed in. Further, in a case in which the point indication 64 is formed by embossing, even when it is difficult to visually recognize the point indication 64, the point indication 64 can be easily recognized through touching. Further, the embossed point indication 64 is visually recognized. Thus, when the shape of the point indication 64 is designed, a design effect of the paper container can be exerted.

The other effects are the same as those of the first example. Thus, description of the first example is applied to support the third example, and description thereof is omitted.

Figure 18:
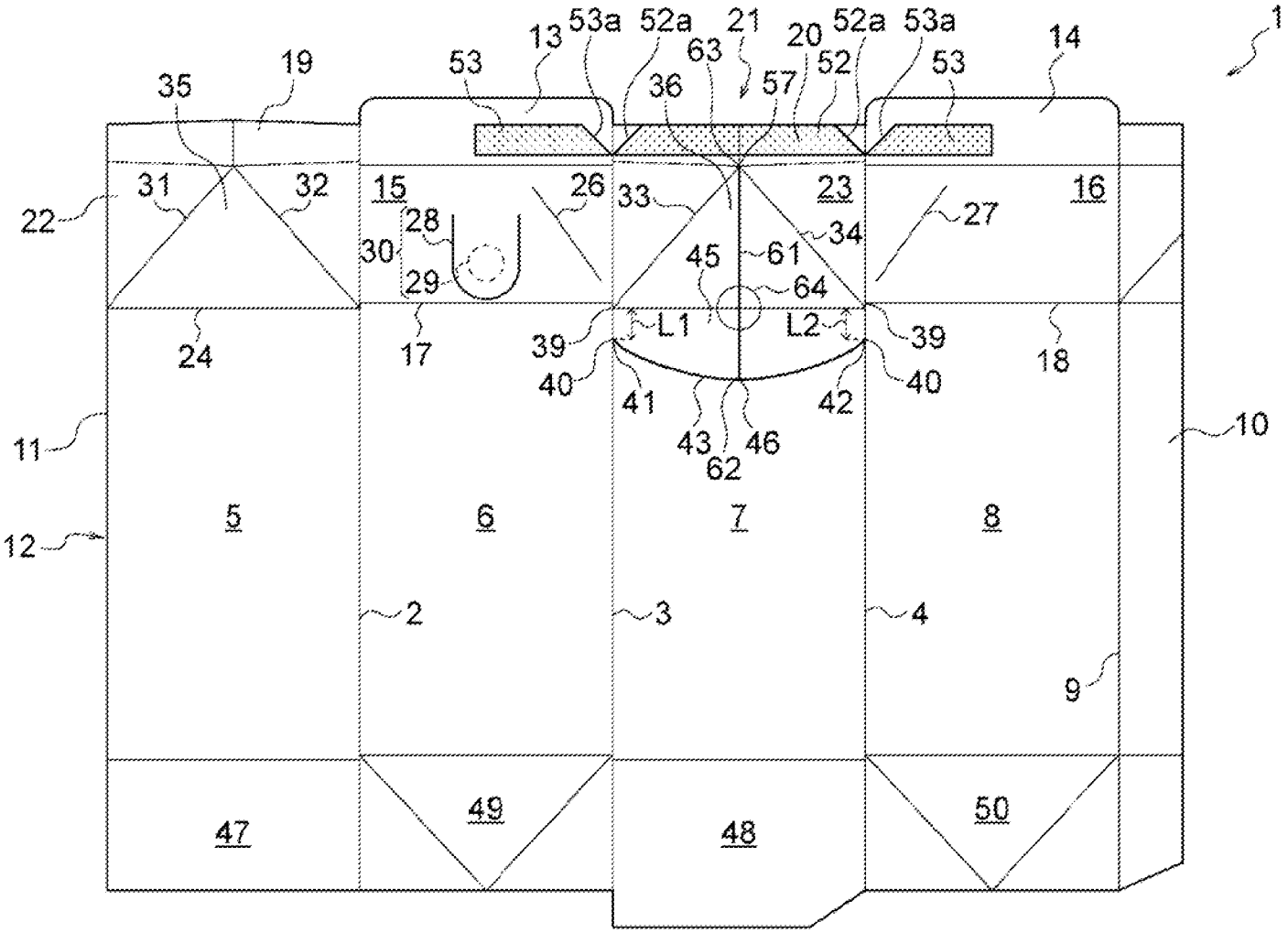
FIG. 18 is a plan view for illustrating a carton blank for a fourth example of the paper container according to the embodiment of the present invention.
Figure 19:
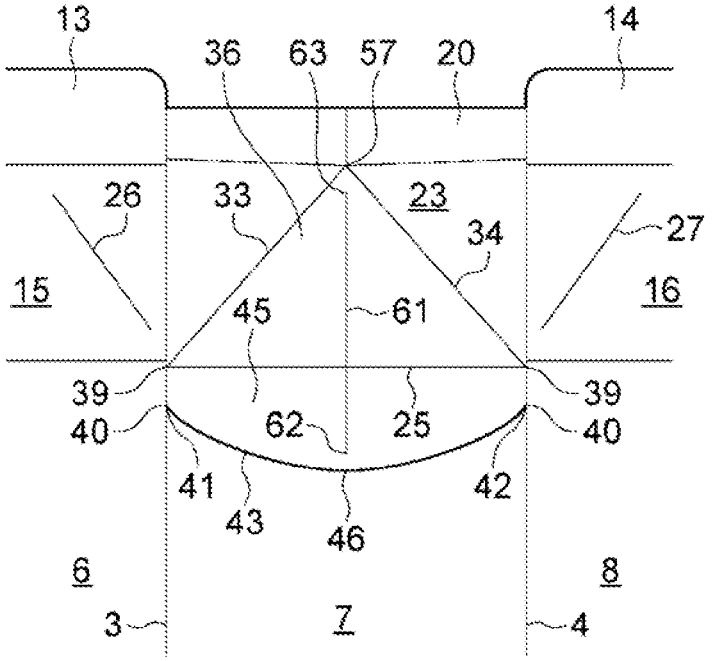
FIG. 19 is an explanatory view for illustrating another example of a shape of the second auxiliary folding line illustrated in FIG. 18.
Figure 20:
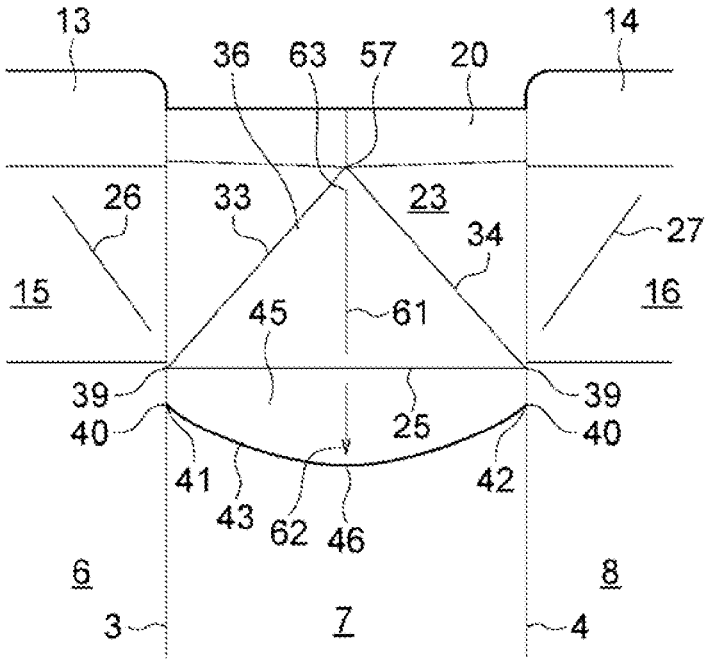
FIG. 20 is an explanatory view for illustrating another example of the shape of the second auxiliary folding line illustrated in FIG. 18.
Figure 21:
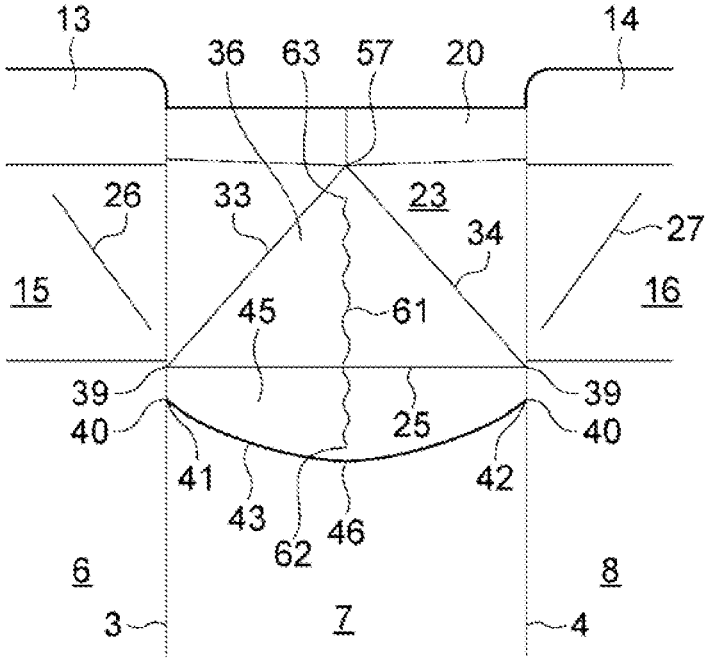
FIG. 21 is an explanatory view for illustrating another example of the shape of the second auxiliary folding line illustrated in FIG. 18.
Figure 22:
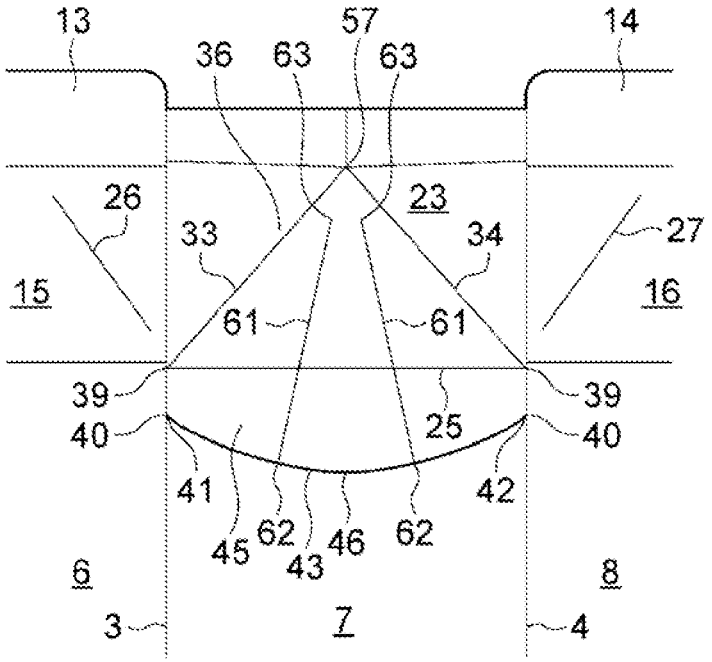
FIG. 22 is an explanatory view for illustrating another example of the shape of the second auxiliary folding line illustrated in FIG. 18.
Figure 23:
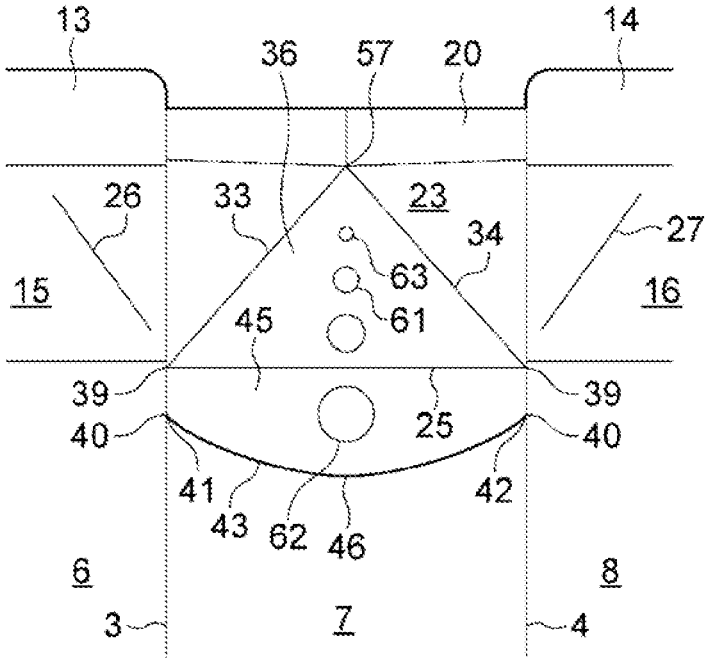
FIG. 23 is an explanatory view for illustrating another example of the shape of the second auxiliary folding line illustrated in FIG. 18.
Figure 24:
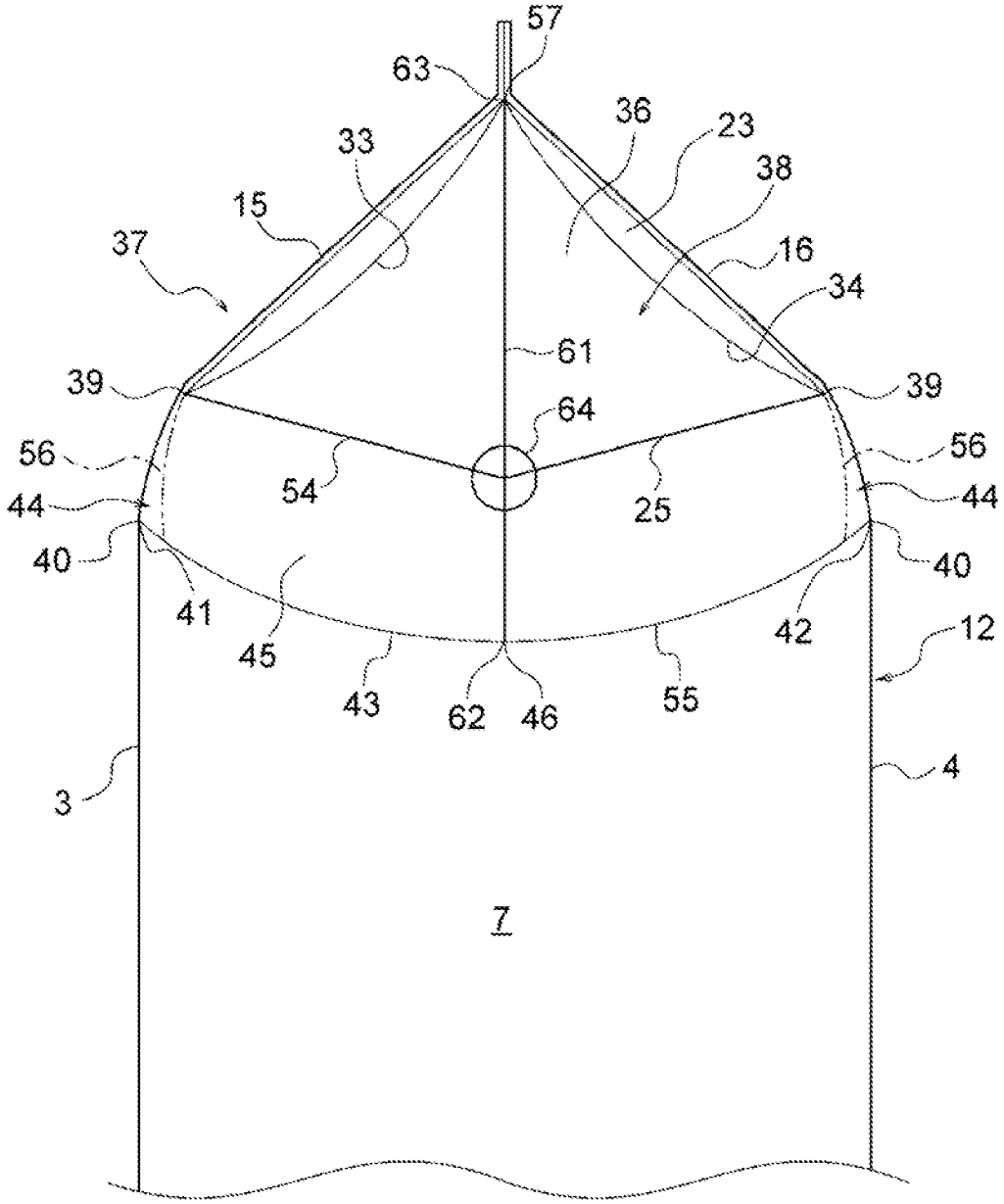
FIG. 24 is an explanatory enlarged side view for illustrating a state in which the paper container formed of the carton blank illustrated in FIG. 18 is folded along the first auxiliary folding line and the second auxiliary folding line.
Figure 25:
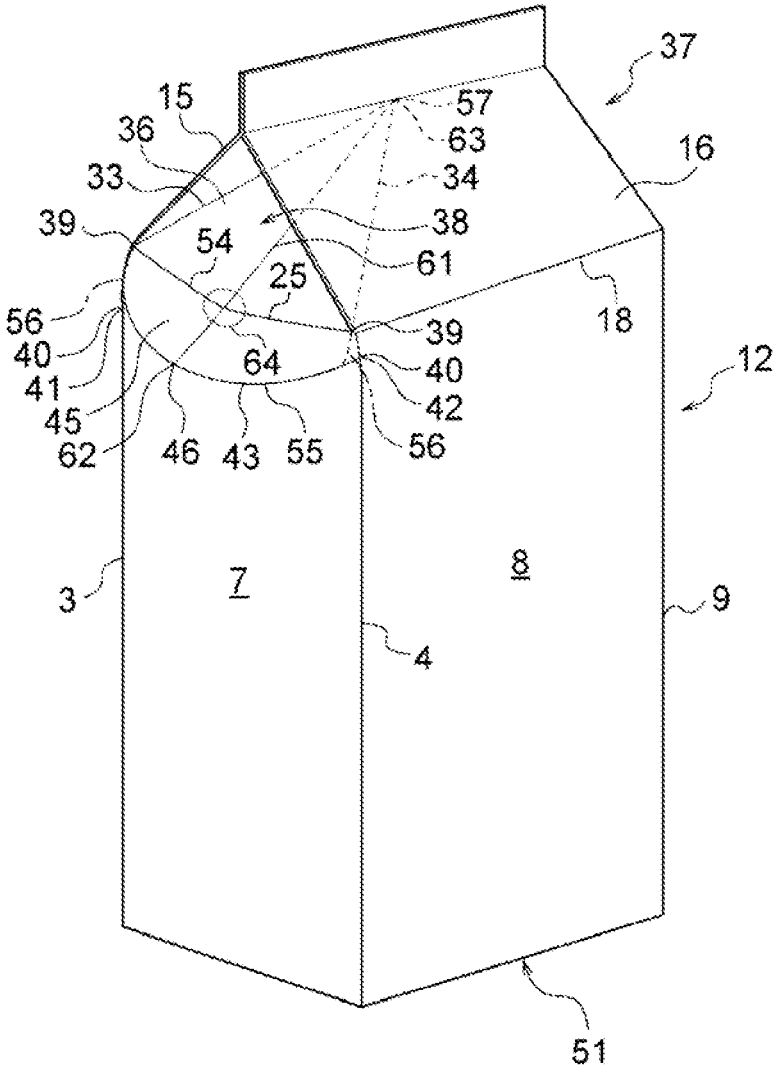
FIG. 25 is a perspective view for illustrating the paper container illustrated in FIG. 24.

FIG. 18 to FIG. 25 are illustrations of a fourth example of the paper container according to the embodiment of the present invention. FIG. 18 is a plan view for illustrating a carton blank for the fourth example of the paper container. FIG. 19, FIG. 20, FIG. 21, FIG. 22, and FIG. 23 are each an explanatory view for illustrating another example of a shape of a second auxiliary folding line illustrated in FIG. 18. FIG. 24 is an explanatory enlarged side view for illustrating a state in which the paper container formed of the carton blank illustrated in FIG. 18 is folded along the first auxiliary folding line and the second auxiliary folding line. FIG. 25 is a perspective view for illustrating the paper container illustrated in FIG. 24.

The fourth example of the paper container has the same basic configuration as that of the third example of the paper container. In the following description, the same components as those of the third example are denoted by the same reference symbols.

The fourth example of the paper container is different from the third example of the paper container in terms of a second auxiliary folding line 61 formed on the unsealed-side body panel 7 and the substantially triangular surface portion 36 of the unsealed-side gable wall forming panel 23 so as to extend from the direction of the lowermost point 46 at the center portion of the first auxiliary folding line 43 to the direction of the vertex 57 of the substantially triangular surface portion 36 across the top portion horizontal folding line 25.

The shape of the second auxiliary folding line 61 is not particularly limited. However, it is preferred that a lower end portion 62 of the second auxiliary folding line 61 on a side of the lowermost point 46 of the first auxiliary folding line 43 be located on the lowermost point 46 of the first auxiliary folding line 43 or in a vicinity of the lowermost point 46, and that an upper end portion 63 of the second auxiliary folding line 61 on a side of the vertex 57 of the substantially triangular surface portion 36 be located on the vertex 57 of the substantially triangular surface portion 36 or in a vicinity of the vertex 57.

In the fourth example, the lower end portion 62 of the second auxiliary folding line 61 is located on the lowermost point 46 of the first auxiliary folding line 43, and the upper end portion 63 is located on the vertex 57 of the substantially triangular surface portion 36.

Further, although not shown, the lower end portion 62 of the second auxiliary folding line 61 may be located on the lowermost point 46 of the first auxiliary folding line 43, and the upper end portion 63 may be located in the vicinity of the vertex 57 of the substantially triangular surface portion 36. Alternatively, the lower end portion 62 of the second auxiliary folding line 61 may be located in the vicinity of the lowermost point 46 of the first auxiliary folding line 43, and the upper end portion 63 may be located on the vertex 57 of the substantially triangular surface portion 36.

FIG. 19, FIG. 20, FIG. 21, FIG. 22, and FIG. 23 are each an illustration of another example of the shape of the second auxiliary folding line 61. In the second auxiliary folding line 61 illustrated in FIG. 19, the lower end portion 62 is located in the vicinity of the lowermost point 46 of the first auxiliary folding line 43, and the upper end portion 63 is located in the vicinity of the vertex 57 of the substantially triangular surface portion 36. In the second auxiliary folding line 61 illustrated in FIG. 20, the lower end portion 62 of the second auxiliary folding line 61 illustrated in FIG. 20 has an arrow-shaped distal end. The second auxiliary folding line 61 illustrated in FIG. 21 has a wavy-line shape. The second auxiliary folding line 61 illustrated in FIG. 22 is formed by two lines. The second auxiliary folding line 61 illustrated in FIG. 23 is formed by a plurality of circles arranged linearly.

A configuration in which the second auxiliary folding line 61 extends across the top portion horizontal folding line 25 does not refer to a configuration in which the second auxiliary folding line 61 always intersects the top portion horizontal folding line 25. The present invention encompasses a configuration in which the second auxiliary folding line 61 is divided by the top portion horizontal folding line 25 and is not continuous with the top portion horizontal folding line 25.

The other configurations are the same as those of the third example. Thus, description of the third example is applied to support the fourth example, and description thereof is omitted.

Similarly to the third example, in the fourth example, at the time of unsealing of the paper container, first, the top-portion corner portion 54 of the tubular body 12 formed by folding the carton blank along the top portion horizontal folding line 25 is pressed so as to be pushed in toward the inner side of the paper container. In this manner, as the top-portion corner portion 54 is pushed in toward the inner side of the paper container, an interior angle of the top-portion corner portion 54 becomes larger, and the upper end portion 45 of the body panel 7 is deformed so as to protrude toward the outer side of the paper container so that a protruding amount becomes larger from the top-portion corner portion 54 toward the lower side of the body panel 7.

In this case, the second auxiliary folding line 61 is formed on the upper end portion 45 of the body panel 7 and the substantially triangular surface portion 36 so as to extend from the direction of the lowermost point 46 at the center portion of the first auxiliary folding line 43 to the direction of the vertex 57 of the substantially triangular surface portion 36 across the top portion horizontal folding line 25. Thus, when the top-portion corner portion 54 is pushed in, the upper end portion 45 of the body panel 7 and the substantially triangular surface portion 36 are valley-folded along the second auxiliary folding line 61 so that the center portion of the top-portion corner portion 54 is guided so as to be folded toward the inner side of the paper container.

When a force of a certain magnitude or more is applied, the paper container is mountain-folded along the first auxiliary folding line 43, and thus a protruding portion 55 protruding outward is formed along the first auxiliary folding line 43. As a result, a buckle 56 (indicated by the dot-and-dash line in FIG. 24 and FIG. 25) appears in a form of a folding line connecting the end portion 41 or the end portion 42 of the first auxiliary folding line 43, or a portion near the end portion 41 or the end portion 42 to the intersection 39.

Then, the top-portion corner portion 54 is bent toward the inner side of the paper container with the center position of the top-portion corner portion 54 being a bending center, and the upper end portion 45 of the body panel 7 and the substantially triangular surface portion 36, which forms the deep plane of the space 38, are dented toward the inner side of the paper container. In this manner, the space 38 is expanded by an amount corresponding to dents of the upper end portion 45 and the substantially triangular surface portion 36, thereby defining the space 38 allowing fingers to be easily inserted thereinto at the time of unsealing.

The other unsealing methods are the same as those of the third example. Thus, description of the third example is applied to support the fourth example, and description thereof is omitted.

According to the fourth example of the paper container configured as described above, the second auxiliary folding line 61 is formed on the body panel 7 and the substantially triangular surface portion 36 so as to extend from the direction of the lowermost point 46 at the center portion of the first auxiliary folding line 43 to the direction of the vertex 57 of the substantially triangular surface portion 36 across the top portion horizontal folding line 25. Thus, when the top-portion corner portion 54 is pushed in, the upper end portion 45 of the body panel 7 and the substantially triangular surface portion 36 are valley-folded along the second auxiliary folding line 61 so that the center portion of the top-portion corner portion 54 is guided so as to be folded toward the inner side of the paper container. Accordingly, the substantially triangular surface portion 36 and the upper end portion 45 of the body panel 7 can be easily dented.

In particular, in a case in which the lower end portion 62 of the second auxiliary folding line 61 on the side of the lowermost point 46 of the first auxiliary folding line 43 is located on the lowermost point 46 of the first auxiliary folding line 43 or in a vicinity of the lowermost point 46, and the upper end portion 63 on the side of the vertex 57 of the substantially triangular surface portion 36 is located on the vertex 57 of the substantially triangular surface portion 36 or in a vicinity of the vertex 57, when the top-portion corner portion 54 is pushed in, the upper end portion 45 of the body panel 7 and the substantially triangular surface portion 36 are easily valley-folded along the second auxiliary folding line 61. Thus, the center portion of the top-portion corner portion 54 is effectively guided so as to be folded toward the inner side of the paper container. As a result, the substantially triangular surface portion 36 and the upper end portion 45 of the body panel 7 can be further easily dented.

Figure 26:
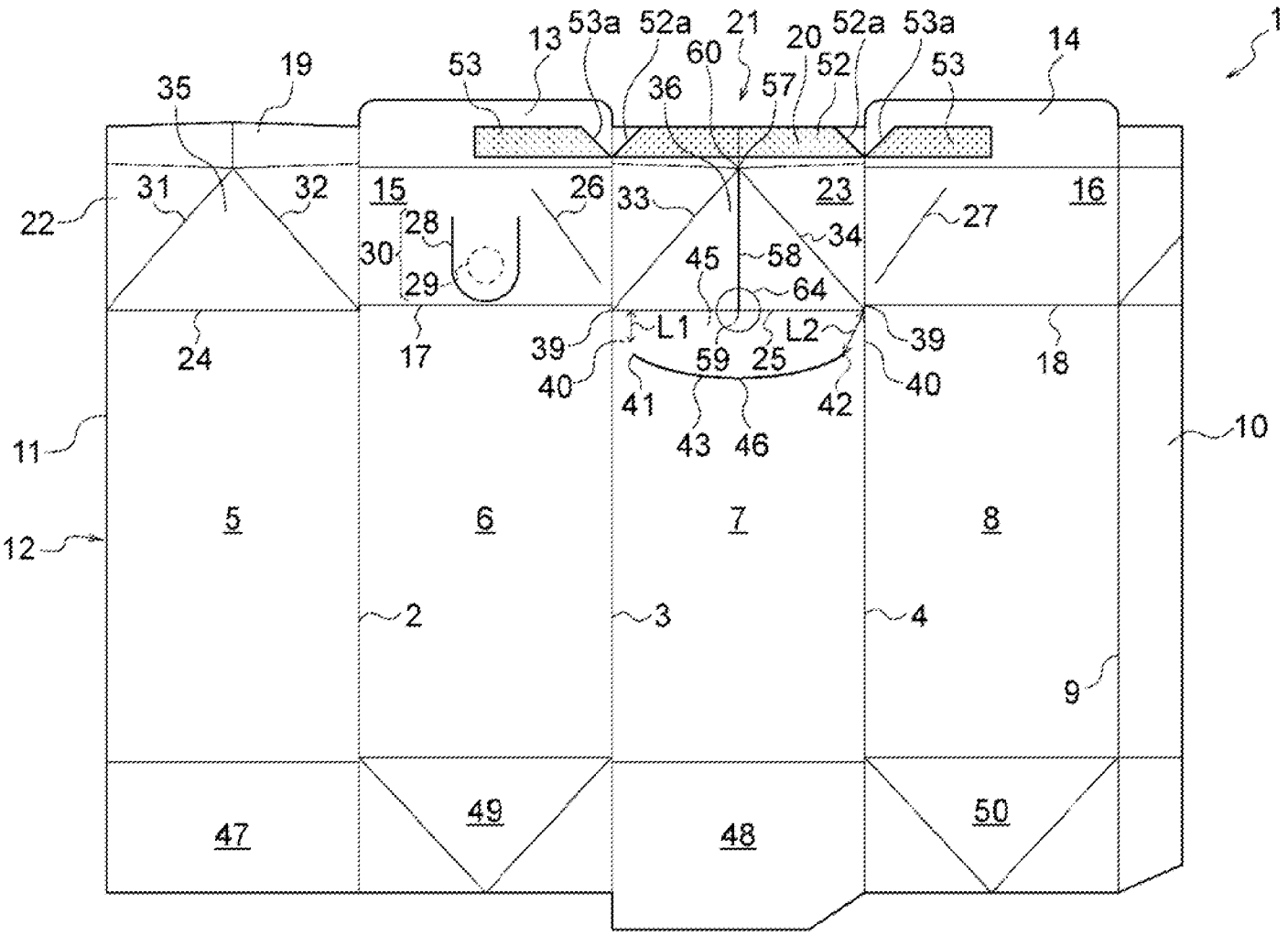
FIG. 26 is a plan view for illustrating a carton blank for a fifth example of the paper container according to the embodiment of the present invention.
Figure 27:
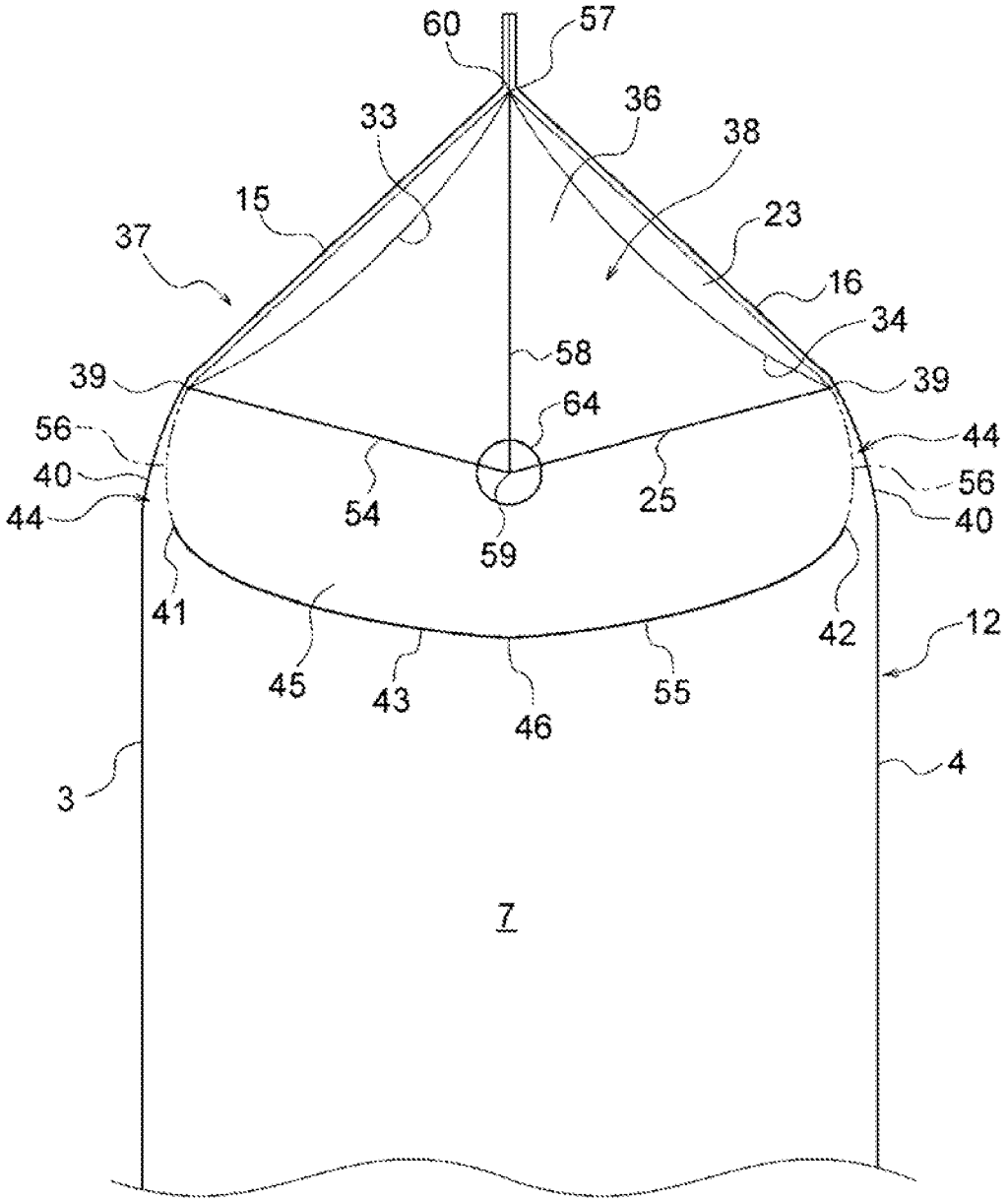
FIG. 27 is an explanatory enlarged side view for illustrating a state in which the paper container formed of the carton blank illustrated in FIG. 26 is folded along the first auxiliary folding line and the second auxiliary folding line.
Figure 28:
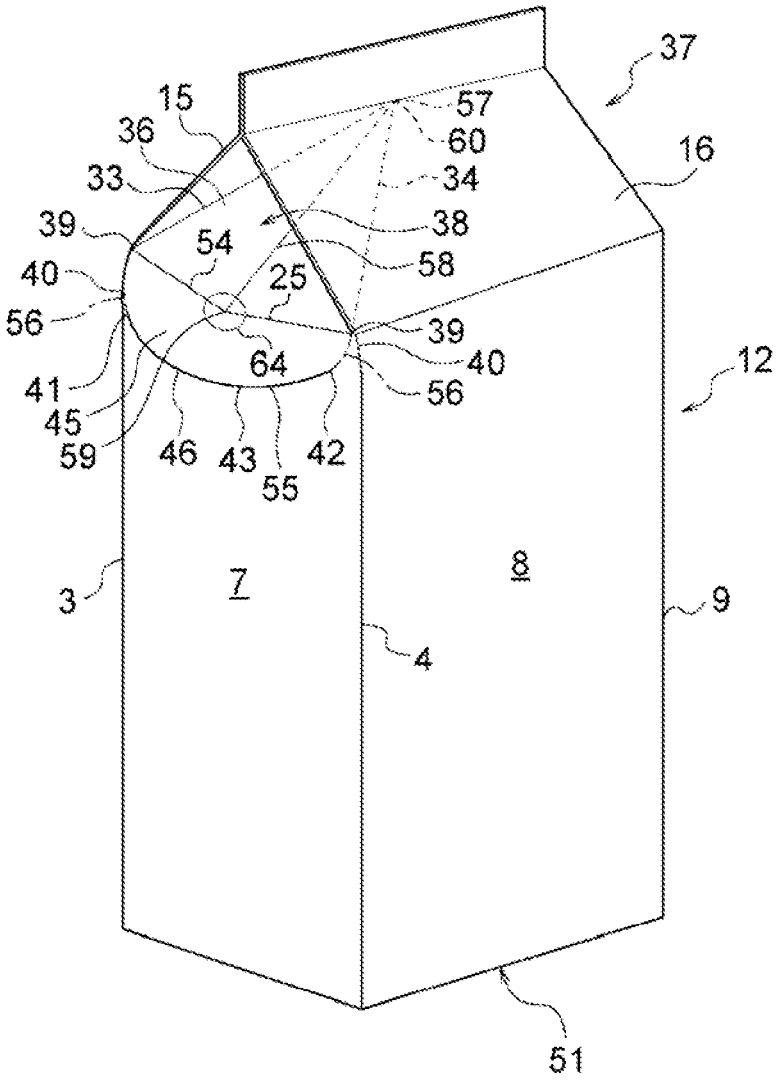
FIG. 28 is a perspective view for illustrating the paper container illustrated in FIG. 27.

FIG. 26 to FIG. 28 are illustrations of a fifth example of the paper container according to the embodiment of the present invention. FIG. 26 is a plan view for illustrating a carton blank for the fifth example of the paper container. FIG. 27 is an explanatory enlarged side view for illustrating a state in which the paper container formed of the carton blank illustrated in FIG. 26 is folded along the first auxiliary folding line and the second auxiliary folding line. FIG. 28 is a perspective view for illustrating the paper container illustrated in FIG. 27.

The fifth example of the paper container has the same basic configuration as that of the third example of the paper container. In the following description, the same components as those of the third example are denoted by the same reference symbols.

The fifth example of the paper container is different from the third example of the paper container in terms of positions of the end portions 41 and 42 of the first auxiliary folding line 43. As illustrated in FIG. 26, similarly to the second example, the first auxiliary folding line 43 in the fifth example has the end portions 41 and 42 arranged so as to connect together positions that are near the reference points 40, away from the body vertical folding lines 3 and 4, and below the reference points 40 in the height direction.

It is preferred that the end portions 41 and 42 of the first auxiliary folding line 43 be each distant from the intersection 39 by 3 mm or more and by a range within the length L2 equal to or smaller than 20% of the length of the top portion horizontal folding line 25.

In the case in which the length L2 is smaller than 3 mm, when pressure is applied to mountain-fold the carton blank along the top portion horizontal folding line 25 at the time of formation of the gable roof-shaped top portion 37 of the paper container, bending load bearing portions 44 are buckled by a small force. Thus, the carton blank is mountain-folded along the first auxiliary folding line 43 and distorted so that a defective product is produced in some cases.

The other configurations are the same as those of the third example. Thus, description of the third example is applied to support the fifth example, and description thereof is omitted.

Similarly to the third example, in the fifth example, at the time of unsealing of the paper container, first, the top-portion corner portion 54 of the tubular body 12 formed by folding the carton blank along the top portion horizontal folding line 25 is pressed so as to be pushed in toward the inner side of the paper container. In this manner, as the top-portion corner portion 54 is pushed in toward the inner side of the paper container, an interior angle of the top-portion corner portion 54 becomes larger, and the upper end portion 45 of the body panel 7 is deformed so as to protrude toward the outer side of the paper container so that a protruding amount becomes larger from the top-portion corner portion 54 toward the lower side of the body panel 7.

Then, when a force of a certain magnitude or more is applied, the paper container is mountain-folded along the first auxiliary folding line 43, and thus the protruding portion 55 protruding outward is formed along the first auxiliary folding line 43. As a result, in the upper end portion 45 of the body panel 7, the buckle 56 (indicated by the dot-and-dash line in FIG. 27 and FIG. 28) appears in a form of a folding line connecting the end portion 41 or the end portion 42 of the first auxiliary folding line 43, or a portion near the end portion 41 or the end portion 42 to the intersection 39.

Then, the top-portion corner portion 54 is bent toward the inner side of the paper container with the center position of the top-portion corner portion 54 being a bending center, and the upper end portion 45 of the body panel 7 and the substantially triangular surface portion 36, which forms the deep plane of the space 38, are dented toward the inner side of the paper container. In this manner, the space 38 is expanded by an amount corresponding to dents of the upper end portion 45 and the substantially triangular surface portion 36, thereby defining the space 38 allowing fingers to be easily inserted thereinto at the time of unsealing.

The unsealing methods are the same as those of the third example. Thus, description of the third example is applied to support the fifth example, and description thereof is omitted.

According to the fifth example of the paper container configured as described above, in the unsealed-side body panel 7 contiguous with the unsealed-side gable wall forming panel 23 through the top portion horizontal folding line 25, on each of the body vertical folding lines 3 and 4 on the both sides of the unsealed-side body panel 7, the reference point 40 is set so as to be distant by a predetermined length from the intersection 39 of the end portion of each of the body vertical folding lines 3 and 4 and the end portion of the top portion horizontal folding line 25. The first auxiliary folding line 43 having an upwardly curved shape is formed to have the end portions 41 and 42 arranged so as to connect together the positions that are near the reference points 40, away from the body vertical folding lines 3 and 4, and below the reference points 40 in the height direction. The end portions 41 and 42 of the first auxiliary folding line 43 are not continuous with the top portion horizontal folding line 25. Thus, when pressure is applied to mountain-fold the carton blank along the top portion horizontal folding line 25 at the time of formation of the gable roof-shaped top portion of the paper container, direct transmission of a force to the first auxiliary folding line 43 is prevented. Accordingly, such a situation that the carton blank is mountain-folded along the first auxiliary folding line 43 does not occur, and hence there is no fear in that the paper container is distorted.

Further, at the time of unsealing of the paper container, when the top-portion corner portion 54 of the tubular body 12 formed by folding the carton blank along the top portion horizontal folding line 25 is pushed in, the paper container is folded along the first auxiliary folding line 43, and the buckles 56 are caused in the bending load bearing portions 44 between the top portion horizontal folding line 25 and the first auxiliary folding line 43 of the body panel 7. In this manner, the upper end portion 45 of the body panel 7 is dented, thereby being capable of easily unsealing the paper container.

Further, deformed portions, which are deformed due to the buckles in the upper end portion 45 of the body panel 7, function as dampers, and can keep the dented state of the upper end portion 45. Accordingly, the paper container can be more easily unsealed.

The other effects are the same as those of the third example. Thus, description of the third example is applied to support the fifth example, and description thereof is omitted.

Figure 29:
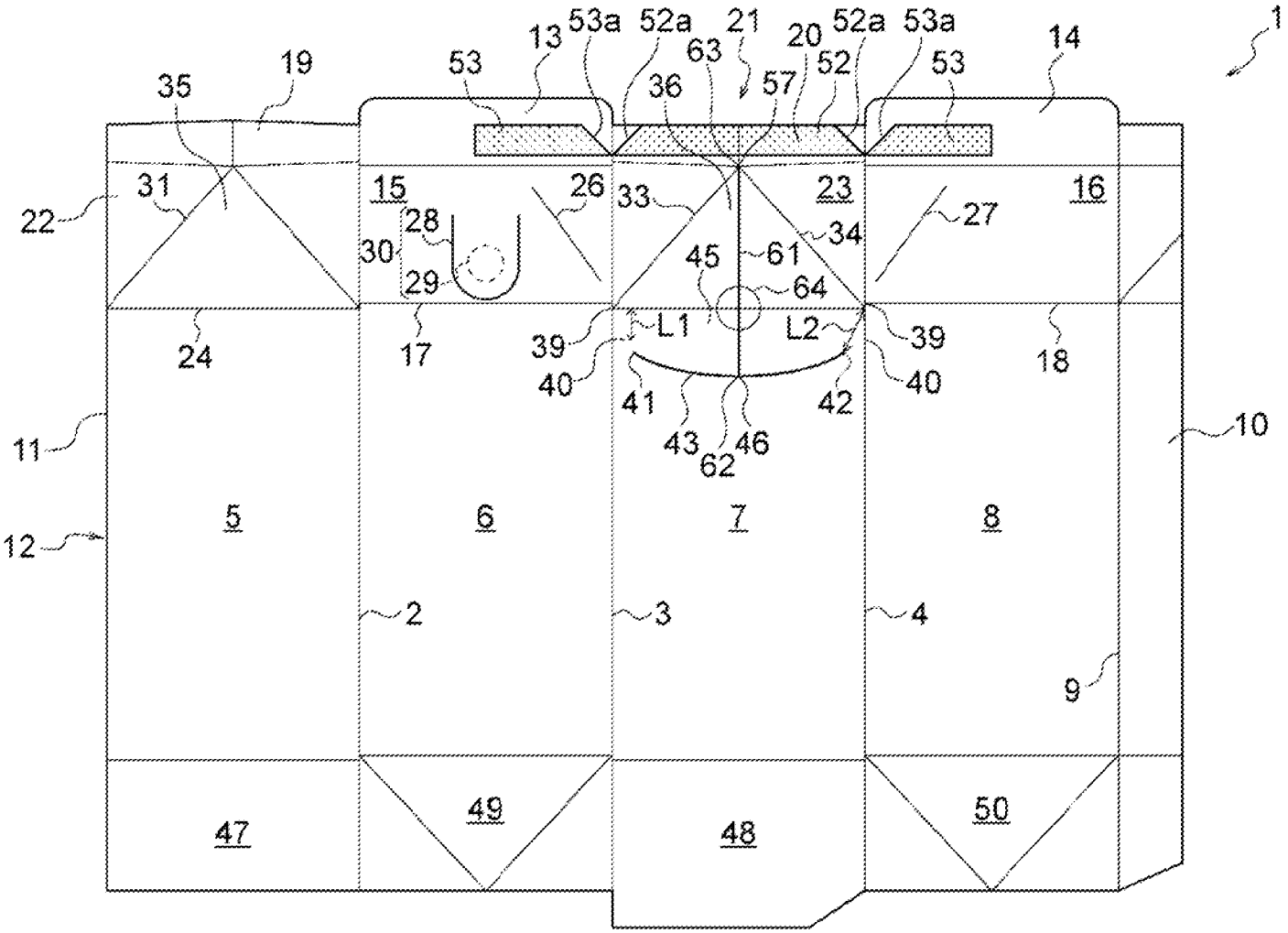
FIG. 29 is a plan view for illustrating a carton blank for a sixth example of the paper container according to the embodiment of the present invention.
Figure 30:
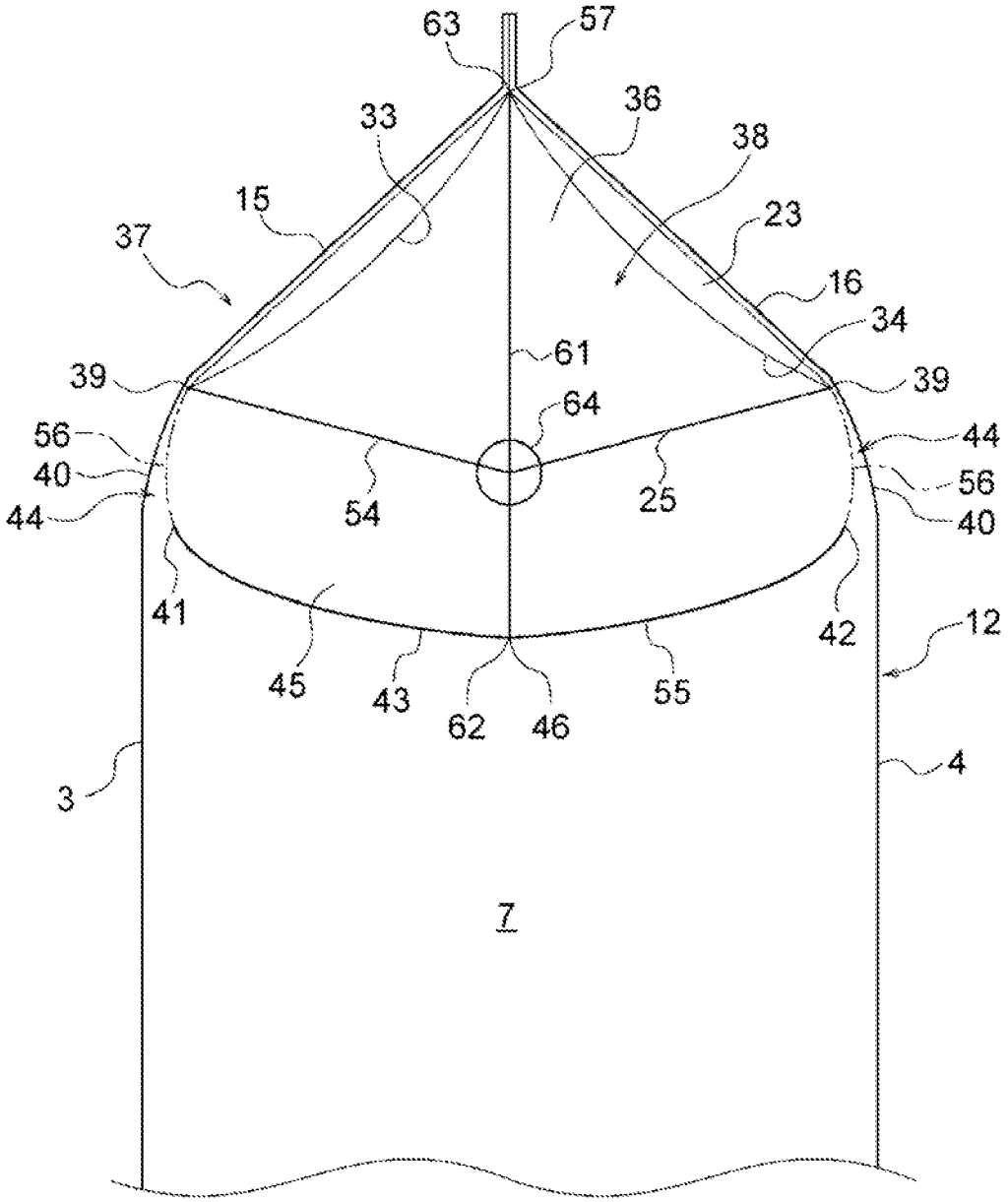
FIG. 30 is an explanatory enlarged side view for illustrating a state in which the paper container formed of the carton blank illustrated in FIG. 29 is folded along the first auxiliary folding line and the second auxiliary folding line.
Figure 31:
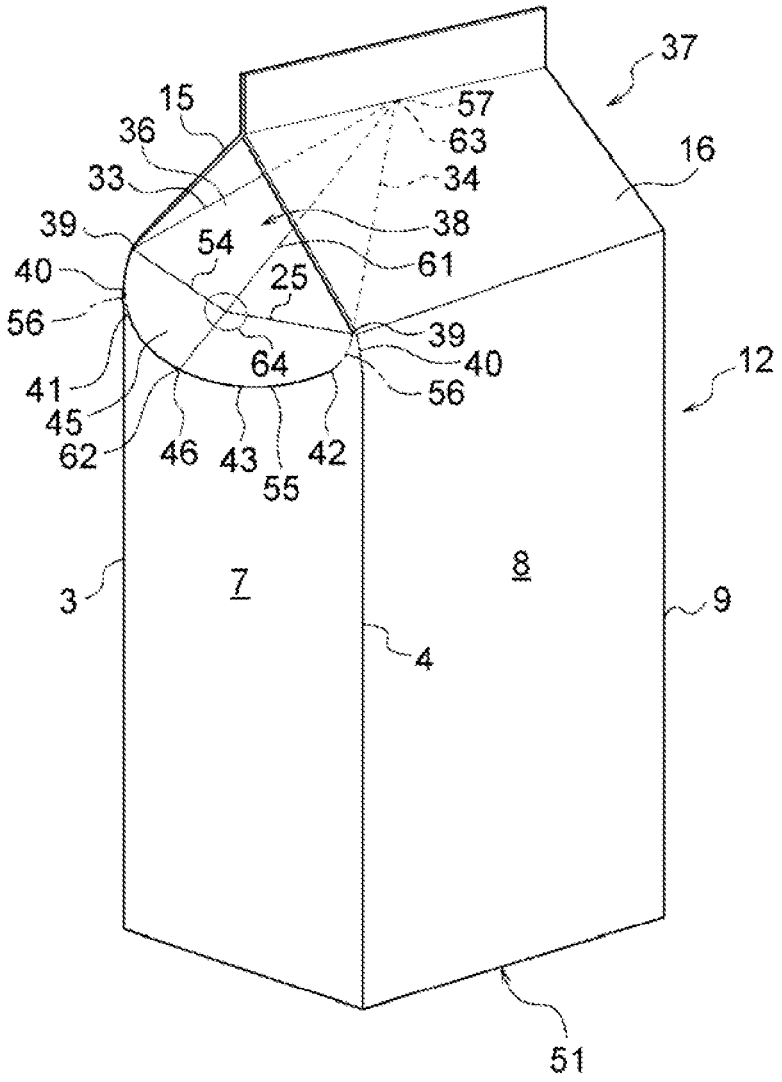
FIG. 31 is a perspective view for illustrating the paper container illustrated in FIG. 30.

FIG. 29 to FIG. 31 are illustrations of a sixth example of the paper container according to the embodiment of the present invention. FIG. 29 is a plan view for illustrating a carton blank for the sixth example of the paper container. FIG. 30 is an explanatory enlarged side view for illustrating a state in which the paper container formed of the carton blank illustrated in FIG. 29 is folded along the first auxiliary folding line and the second auxiliary folding line. FIG. 31 is a perspective view for illustrating the paper container illustrated in FIG. 30.

The sixth example of the paper container has the same basic configuration as that of the fifth example of the paper container. In the following description, the same components as those of the fifth example are denoted by the same reference symbols.

The sixth example of the paper container is different from the fifth example of the paper container in terms of the second auxiliary folding line 61 formed on the unsealed-side body panel 7 and the substantially triangular surface portion 36 of the unsealed-side gable wall forming panel 23 so as to extend from the direction of the lowermost point 46 at the center portion of the first auxiliary folding line 43 to the direction of the vertex 57 of the substantially triangular surface portion 36 across the top portion horizontal folding line 25.

The shape of the second auxiliary folding line 61 is the same as that of the second auxiliary folding line 61 of the paper container in the fifth example. Thus, the drawings for illustrating the second auxiliary folding line 61 in the fifth example and description of the second auxiliary folding line 61 in the fifth example are applied to support the sixth example, and description thereof is omitted.

The other configurations are also the same as those of the fifth example. Thus, description of the fifth example is applied to support the sixth example, and description thereof is omitted.

The unsealing of the paper container in the six example is the same as that of the fifth example. Thus, description of the fifth example is applied to support the sixth example, and description thereof is omitted.

Similarly to the fifth example, according to the sixth example of the paper container configured as described above, in the unsealed-side body panel 7 contiguous with the unsealed-side gable wall forming panel 23 through the top portion horizontal folding line 25, on each of the body vertical folding lines 3 and 4 on the both sides of the unsealed-side body panel 7, the reference point 40 is set so as to be distant by a predetermined length from the intersection 39 of the end portion of each of the body vertical folding lines 3 and 4 and the end portion of the top portion horizontal folding line 25. The first auxiliary folding line 43 having an upwardly curved shape is formed to have the end portions 41 and 42 arranged so as to connect together the positions that are near the reference points 40, away from the body vertical folding lines 3 and 4, and below the reference points 40 in the height direction. The end portions 41 and 42 of the first auxiliary folding line 43 are not continuous with the top portion horizontal folding line 25. Thus, when pressure is applied to mountain-fold the carton blank along the top portion horizontal folding line 25 at the time of formation of the gable roof-shaped top portion of the paper container, direct transmission of a force to the first auxiliary folding line 43 is prevented. Accordingly, such a situation that the carton blank is mountain-folded along the first auxiliary folding line 43 and distorted so that a defective product is produced can be effectively prevented.

Further, at the time of unsealing of the paper container, when the top-portion corner portion 54 of the tubular body 12 formed by folding the carton blank along the top portion horizontal folding line 25 is pushed in, the paper container is folded along the first auxiliary folding line 43, and the buckles 56 are caused in the bending load bearing portions 44 between the top portion horizontal folding line 25 and the first auxiliary folding line 43 of the body panel 7. In this manner, the upper end portion 45 of the body panel 7 is dented, thereby being capable of easily unsealing the paper container.

Further, deformed portions, which are deformed due to the buckles in the upper end portion 45 of the body panel 7, function as dampers, and can keep the dented state of the upper end portion 45. Accordingly, the paper container can be more easily unsealed.

The other effects are the same as those of the fifth example. Thus, description of the fifth example is applied to support the sixth example, and description thereof is omitted.

REFERENCE SIGNS LIST

1 carton blank
2, 3, 4 body vertical folding line
5, 6, 7, 8 body panel
9 body vertical folding line
10 vertical direction sealing panel
11 edge portion
12 tubular body
13, 14 outer-side top sealing panel
15, 16 gable roof forming panel
17, 18 top portion horizontal folding line

19, 20 inner-side top sealing panel
21 pouring spout
22, 23 gable wall forming panel
24, 25 top portion horizontal folding line
26, 27 guide folding line
28 second half-cut portion
29 first half-cut portion
30 pouring spout for straw
31, 32, 33, 34 tuck-in folding line
35, 36 substantially triangular surface portion
37 top portion
38 space
39 intersection
40 reference point
41, 42 end portion of first auxiliary folding line
43 first auxiliary folding line
44 bending load bearing portion
45 upper end portion of unsealed-side body panel
46 lowermost point of first auxiliary folding line
47, 48 bottom forming panel
49, 50 inner panel
51 bottom portion
52 first easily-separable region
52*a* extended portion
53 second easily-separable region
53*a* extended portion
54 top-portion corner portion
55 protruding portion
56 buckle
57 vertex of substantially triangular surface portion
58 second auxiliary folding line
59 lower end portion of second auxiliary folding line
60 upper end portion of second auxiliary folding line
61 second auxiliary folding line
62 lower end portion of second auxiliary folding line
63 upper end portion of second auxiliary folding line
64 point indication
L1 length from reference point to intersection
L2 length from end portion of first auxiliary folding line to intersection

The invention claimed is:

1. A paper container, which includes a gable roof and is formed of a paperboard material having a thermoplastic resin laminated on each of a front surface of the paperboard material and a back surface of the paperboard material, the paper container comprising:

four body panels;

a vertical direction sealing panel, which joins edge portions of the four body panels so that the four body panels form a quadrangular tubular body;

two gable roof forming panels, which are contiguous with upper ends of a first pair of the four body panels, and include outer-side top sealing panels at upper portions of the two gable roof forming panels, respectively, and are opposed to each other;

two gable wall forming panels, which are contiguous with upper ends of a second pair of the four body panels, and include inner-side top sealing panels at upper portions of the two gable wall forming panels, respectively, and are opposed to each other, any one of the two gable wall forming panels being configured to be formed into a pouring spout to be unsealed; and a top portion formed by folding the two gable wall forming panels between the two gable roof forming panels, and by heating, sealing, and closing the outer-side top sealing panels and the inner-side top sealing panels at predetermined positions, wherein, in an unsealed-side body panel among the four body panels, which is contiguous with an unsealed-side gable wall forming panel among the two gable wall forming panels through a top portion horizontal folding line, reference points are respectively set on body vertical folding lines that are located on both sides of the unsealed-side body panel, wherein each of the reference points is distant by 3 mm or more from an intersection of an end portion of one of the body vertical folding lines and an end portion of the top portion horizontal folding line, wherein, on the unsealed-side body panel, a first auxiliary folding line having an upwardly curved shape is formed to have end portions arranged so as to connect the reference points to each other, or connect together positions that are near the reference points on the body vertical folding lines or positions that are away from the body vertical folding lines and below the reference points in a height direction of each of the body vertical folding lines, wherein the end portions of the first auxiliary folding line, which connect together the positions that are near the reference points on the body vertical folding lines or the positions that are away from the body vertical folding lines and below the reference points in the height direction, are each distant from the intersection by 3 mm or more and by a range within a length equal to or smaller than 20% of a length of the top portion horizontal folding line, and wherein a second auxiliary folding line extends along a vertical centerline of the paper container and is formed on at least one of the unsealed-side body panel or a substantially triangular surface portion of the unsealed-side gable wall forming panel.

2. The paper container according to claim 1, wherein each of the reference points is distant from the intersection by a length of from 3 mm to 4 mm in an up-and-down direction of the paper container, and wherein each of the end portions of the first auxiliary folding line is distant from the intersection by a length of from 5 mm to 6 mm.

3. The paper container according to claim 1, wherein the upwardly curved shape of the first auxiliary folding line is an arc shape, a V shape, a polygonal shape, or a combination thereof.

4. The paper container according to claim 1, wherein the first auxiliary folding line is a continuous line.

5. The paper container according to claim 1, wherein the first auxiliary folding line includes discontinuous lines.

6. The paper container according to claim 1, wherein a lowermost point of a curve of the first auxiliary folding line is located at a center of the unsealed-side body panel in a right-and-left direction of the unsealed-side body panel.

7. The paper container according to claim 1, wherein the first auxiliary folding line is symmetrical.

8. The paper container according to claim 1, wherein a lower end portion of the second auxiliary folding line on a side of a lowermost point of the first auxiliary folding line is located on the lowermost point of the first auxiliary folding line or in a vicinity of the lowermost point of the first auxiliary folding line, and wherein an upper end portion of the second auxiliary folding line on a side of a vertex of the substantially triangular surface portion is located on the vertex of the substantially triangular surface portion or in a vicinity of the vertex of the substantially triangular surface portion.

9. The paper container according to claim 1, wherein a point indication for indicating a pushing point is on a center portion of the top portion horizontal folding line or in a vicinity of the center portion of the top portion horizontal folding line so as to extend astride the substantially triangular surface portion and one of the four body panels or extend in any one of the substantially triangular surface portion and one of the four body panels.

10. The paper container according to claim 9, wherein the point indication is formed by embossing.

11. The paper container according to claim 1, wherein the inner-side top sealing panel, which is contiguous with the upper portion of the one of the two gable wall forming panels configured to be formed into the pouring spout to be unsealed, has a straight upper side.

12. The paper container according to claim 1, wherein a first separable region is formed on an inner surface of the inner-side top sealing panel, which is contiguous with the upper portion of the one of the two gable wall forming panels configured to be formed into the pouring spout to be unsealed, and wherein a second separable region, which is to be superposed on the first separable region, is formed on a portion of an inner surface of each of the outer-side top sealing panels on a side closer to the inner-side top sealing panel so as to cover almost half of each of the outer-side top sealing panels in a lateral length direction thereof, and the outer-side top sealing panels are located on both sides of the inner-side top sealing panel, and are contiguous with the upper portions of the two gable roof forming panels, respectively.

13. The paper container according to claim 12, wherein the first separable region is formed such that an end sealing region having a predetermined lateral width is left at each end of the inner-side top sealing panel in a lateral length direction thereof, wherein the second separable region is formed such that an end sealing region having a predetermined lateral width is left at a portion of each of the outer-side top sealing panels on the side closer to the inner-side top sealing panel, wherein the first separable region includes extended portions, and the extended portions are respectively formed at both end portions of the first separable region so as to extend in an inclined manner from an upper side of the first separable region to a lower side of the first separable region so that widths become larger toward one of the four body panels, and wherein the second separable region includes an extended portion, and the extended portion is formed at an end portion of the second separable region on the side closer to the inner-side top sealing panel so as to extend in an inclined manner from an upper side of the second separable region to a lower side of the second separable region so that a width becomes larger toward one of the four body panels.

14. The paper container according to claim 1, wherein a lateral width of each of the four body panels is equal to or smaller than 57 mm.

15. The paper container according to claim 1, wherein, in at least one of the two gable roof forming panels, a pouring spout for a straw is formed, and includes a first half-cut portion formed on a back surface side of the at least one of the two gable roof forming panels so as to serve as a straw slot, and a second half-cut portion formed on a front surface side of the at least one of the two gable roof forming panels so as to surround the first half-cut portion.

16. A paper container, which includes a gable roof and is formed of a paperboard material having a thermoplastic resin laminated on each of a front surface of the paperboard material and a back surface of the paperboard material, the paper container comprising:

four body panels;

a vertical direction sealing panel, which joins edge portions of the four body panels so that the four body panels form a quadrangular tubular body;

two gable roof forming panels, which are contiguous with upper ends of a first pair of the four body panels, and include outer-side top sealing panels at upper portions of the two gable roof forming panels, respectively, and are opposed to each other;

two gable wall forming panels, which are contiguous with upper ends of a second pair of the four body panels, and include inner-side top sealing panels at upper portions of the two gable wall forming panels, respectively, and are opposed to each other, any one of the two gable wall forming panels being configured to be formed into a pouring spout to be unsealed; and a top portion formed by folding the two gable wall forming panels between the two gable roof forming panels, and by heating, sealing, and closing the outer-side top sealing panels and the inner-side top sealing panels at predetermined positions, wherein, in an unsealed-side body panel among the four body panels, which is contiguous with an unsealed-side gable wall forming panel among the two gable wall forming panels through a top portion horizontal folding line, reference points are respectively set on body vertical folding lines that are located on both sides of the unsealed-side body panel, wherein each of the reference points is distant by 3 mm or more from an intersection of an end portion of one of the body vertical folding lines and an end portion of the top portion horizontal folding line, wherein, on the unsealed-side body panel, a first auxiliary folding line having an upwardly curved shape is formed to have end portions arranged so as to connect the reference points to each other, or connect together positions that are near the reference points on the body vertical folding lines or positions that are away from the body vertical folding lines and below the reference points in a height direction of each of the body vertical folding lines, wherein the end portions of the first auxiliary folding line, which connect together the positions that are near the reference points on the body vertical folding lines or the positions that are away from the body vertical folding lines and below the reference points in the height direction, are each distant from the intersection by 3 mm or more and by a range within a length equal to or smaller than 20% of a length of the top portion horizontal folding line, and wherein the first auxiliary folding line includes discontinuous lines.

* * * * *